US010359728B2

(12) United States Patent
Kitajima

(10) Patent No.: US 10,359,728 B2
(45) Date of Patent: Jul. 23, 2019

(54) IMAGE FORMING APPARATUS

(71) Applicant: CANON KABUSHIKI KAISHA, Tokyo (JP)

(72) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/808,115

(22) Filed: Nov. 9, 2017

(65) Prior Publication Data

US 2018/0143561 A1 May 24, 2018

(30) Foreign Application Priority Data

Nov. 18, 2016 (JP) ..... 2016-225552

(51) Int. Cl.
*G03G 15/02* (2006.01)
*G03G 15/00* (2006.01)

(52) U.S. Cl.
CPC ..... *G03G 15/55* (2013.01); *G03G 15/02* (2013.01); *G03G 15/0233* (2013.01); *G03G 15/0291* (2013.01); *G03G 15/5016* (2013.01); *G03G 15/5037* (2013.01); *G03G 15/0258* (2013.01); *G03G 15/0266* (2013.01);
(Continued)

(58) Field of Classification Search
CPC ..... G03G 15/02; G03G 15/0233; G03G 15/0258; G03G 15/0266; G03G 15/0283; G03G 15/0291; G03G 15/5033; G03G 15/5037; G03G 15/5016; G03G 15/5079; G03G 15/55; G03G 15/553;
(Continued)

(56) References Cited

U.S. PATENT DOCUMENTS 5,839,024 A * 11/1998 May ..... G03G 15/0291 399/89
7,680,428 B2 * 3/2010 Sakato ..... G03G 15/0258 399/100
(Continued)

FOREIGN PATENT DOCUMENTS

JP 2004-198909 A 7/2004
JP 2005-107200 A 4/2005
(Continued)

OTHER PUBLICATIONS

U.S. Appl. No. 15/664,419, filed Jul. 31, 2017, Kenichiro Kitajima.
(Continued)

*Primary Examiner* — Joseph S Wong
(74) *Attorney, Agent, or Firm* — Venable LLP

(57) ABSTRACT

An image forming apparatus includes a photosensitive member, a corona charger including a discharging electrode and a grid electrode having a surface layer containing carbon atoms as a main component and configured to electrically charge the photosensitive member under application of a voltage to the discharging electrode and the grid electrode, and an output portion configured to output information on a lifetime of the grid electrode. The output portion outputs the information on the basis of an index value of an amount of use of the grid electrode correlating with a product of a value of a grid current flowing through the grid electrode and a time of flowing of the grid current through the grid electrode.

18 Claims, 16 Drawing Sheets

(52) U.S. Cl.
CPC ..... *G03G 15/0283* (2013.01); *G03G 15/553* (2013.01); *G03G 2215/00071* (2013.01); *G03G 2215/026* (2013.01); *G03G 2215/027* (2013.01)

(58) Field of Classification Search
CPC ... G03G 2215/00071; G03G 2215/026; G03G 2215/027
See application file for complete search history.

(56) References Cited

U.S. PATENT DOCUMENTS

| | | | | |
|---|---|---|---|---|
| 7,835,667 | B2 | 11/2010 | Ohno et al. | |
| 8,090,297 | B2 | 1/2012 | Hano | |
| 2004/0081485 | A1* | 4/2004 | Song | G03G 15/0291 399/171 |
| 2006/0045559 | A1* | 3/2006 | Zona | G03G 15/0258 399/100 |

FOREIGN PATENT DOCUMENTS

| | | | |
|---|---|---|---|
| JP | 5092474 | B2 | 12/2012 |
| JP | 5414198 | B2 | 2/2014 |

OTHER PUBLICATIONS

U.S. Appl. No. 15/806,811, filed Nov. 8, 2017, Kenichiro Kitajima.

* cited by examiner (a)

(b)

| PORTION | APERTURE | PITCH |
|---|---|---|
| 31b | 90% | 0.76(mm) |
| 32b | 80% | 0.38(mm) |

(a)

(b)

(a)

(b)

(a)

(b)

(a)

(b)

IMAGE FORMING APPARATUS

FIELD OF THE INVENTION AND RELATED ART

The present invention relates to an image forming apparatus, of an electrophotographic type, such as a copying machine, a printer or a facsimile machine. Particularly, the present invention relates to the image forming apparatus including a corona charger provided with a grid electrode surface-coated with a coating material containing carbon atoms as a main component.

In the image forming apparatus of the electrophotographic type, as a charging means for electrically charging a photosensitive member (electrophotographic photosensitive member), the corona charger has been widely used. The grid electrode of the corona charger is liable to corrode due to oxidation by electric discharge. When the corrosion of the grid electrode occurs, in some cases, charging non-uniformity of the photosensitive member generates and thus image defect generates.

Therefore, in Japanese Patent No. 5092474, in order to suppress the corrosion of the grid electrode, a surface of a substrate (base material) of the grid electrode has been coated with a coating material. For example, a method of coating the surface of the substrate of the grid electrode with the coating material which contains the carbon atom as the main component and which has an sp3 structure is disclosed. Further, in Japanese Patent No. 5414198, a method in which a stainless steel material of 1 mm in aperture (opening) width of a mesh-shaped isolated opening is used as the substrate of the grid electrode and in which the surface of the substrate is coated with tetrahedral amorphous carbon (Ta—C) is disclosed.

Thus, at the surface of the substrate of the grid electrode, a surface layer (hereinafter, also referred to as a "surface coating") containing the carbon atom as the main component is provided, and a film thickness (thickness) of this surface coating is set at about 10 nm-100 nm, so that the corrosion of the grid electrode can be suppressed.

However, for example, in an image forming apparatus which includes a negatively chargeable photosensitive member having a relatively large electrostatic capacity and which has a relatively high image forming speed, even when the grid electrode provided with the surface coating as described above is used, charging non-uniformity generates in some cases when repetitive image formation is carried out. It turned out this is because even such a grid electrode decreases in film thickness of the surface coating with an increase in time in which the charging procedure of the photosensitive member is carried out (hereinafter, also referred to as a "charging time") and thus the stainless steel material as the substrate gradually corrodes.

Thus, even in the case where the grid electrode is provided with the surface coating containing the carbon atom as the main component, a corrosion resistance property of the grid electrode is not a permanent one, so that the grid electrode reaches the end of its lifetime eventually due to the decrease in film thickness of the surface coating. For that reason, in the image forming apparatus, it is desired that the lifetime of the grid electrode provided with the surface coating is discriminated and then the grid electrode is exchanged at proper timing.

As described above, the film thickness of the surface coating generally decreases with the increase in charging time. However, it turned out that even when the lifetime of the grid electrode is discriminated simply on the basis of the charging time, the lifetime of the grid electrode cannot be discriminated with accuracy. It turned out that this is because a grid current which is discharging current flowing into the grid electrode is different depending on a charging property (such as a dark decay amount) of the photosensitive member, setting of a charging voltage (such as setting of a charge potential or setting of a current supplied to a discharging electrode), or the like. Further, it turned out that even when the grid current is the same, the lifetime of the grid electrode is influenced by a constitution of the corona charger, particularly by an aperture ratio of the grid electrode.

SUMMARY OF THE INVENTION

According to an aspect of the present invention, there is provided an image forming apparatus comprising: a photosensitive member; a corona charger including a discharging electrode and a grid electrode having a surface layer containing a carbon atom as a main component and configured to electrically charge the photosensitive member under application of a voltage to the discharging electrode and the grid electrode; and an output portion configured to output information on a lifetime of the grid electrode, wherein the output portion outputs the information on the basis of an index value of an amount of use of the grid electrode correlating with a product of a value of a grid current flowing through the grid electrode and a time of flowing of the grid current through the grid electrode.

Further features of the present invention will become apparent from the following description of exemplary embodiments with reference to the attached drawings.

Figure 3:
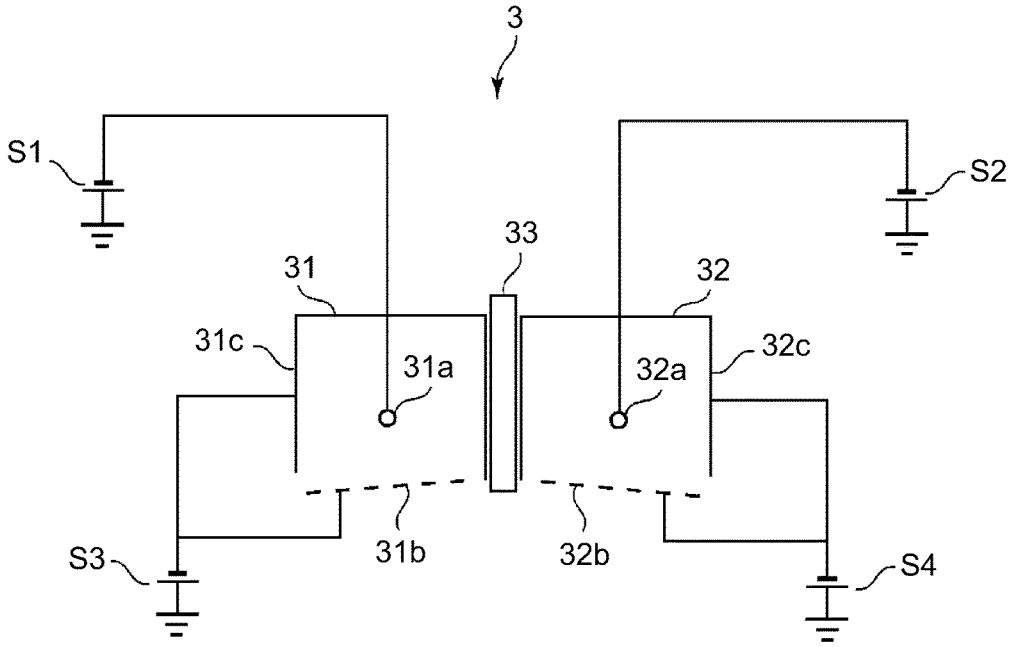
Figure 3:
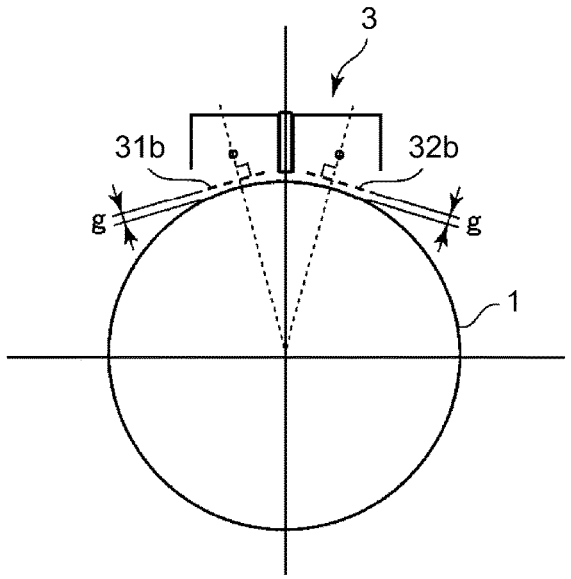

Parts (a) and (b) of FIG. 3 are schematic sectional views of a charging device.

Figure 4:
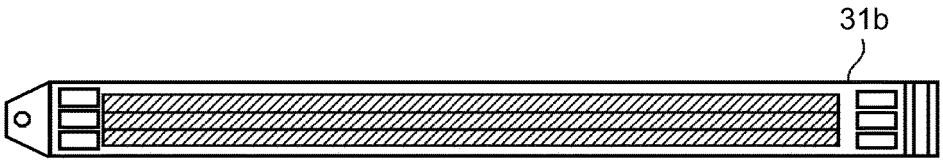
Figure 4:
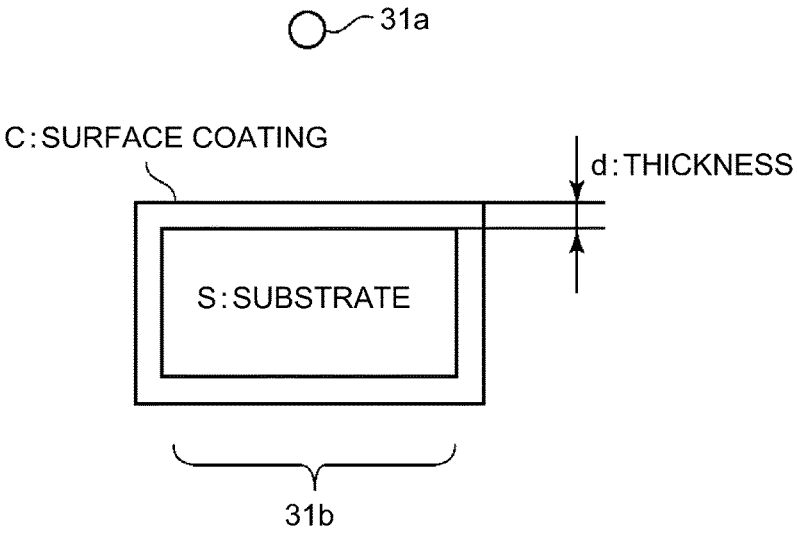

Parts (a) and (b) of FIG. 4 are schematic plan view and sectional view, respectively, of a grid electrode.

Figure 5:
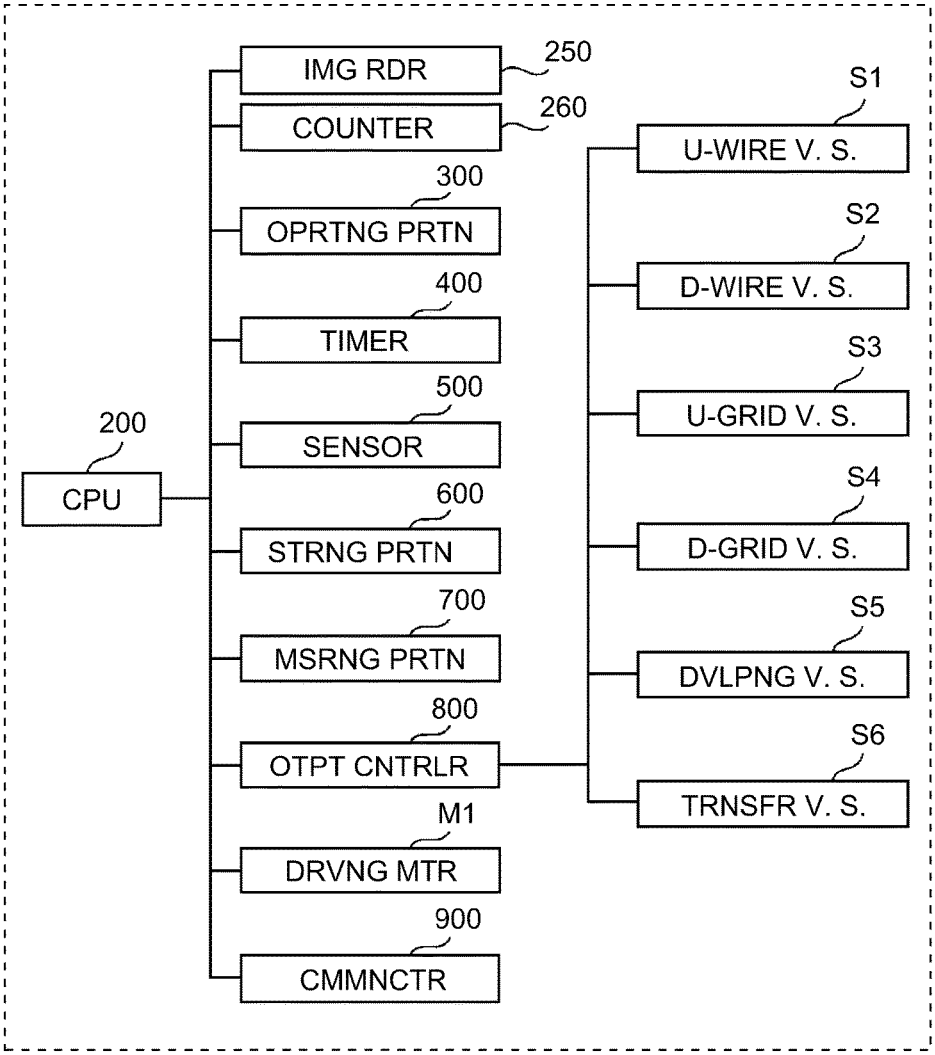

FIG. 5 is a block diagram showing a control mode of a principal part of the image forming apparatus in Embodiment 1.

Figure 6:
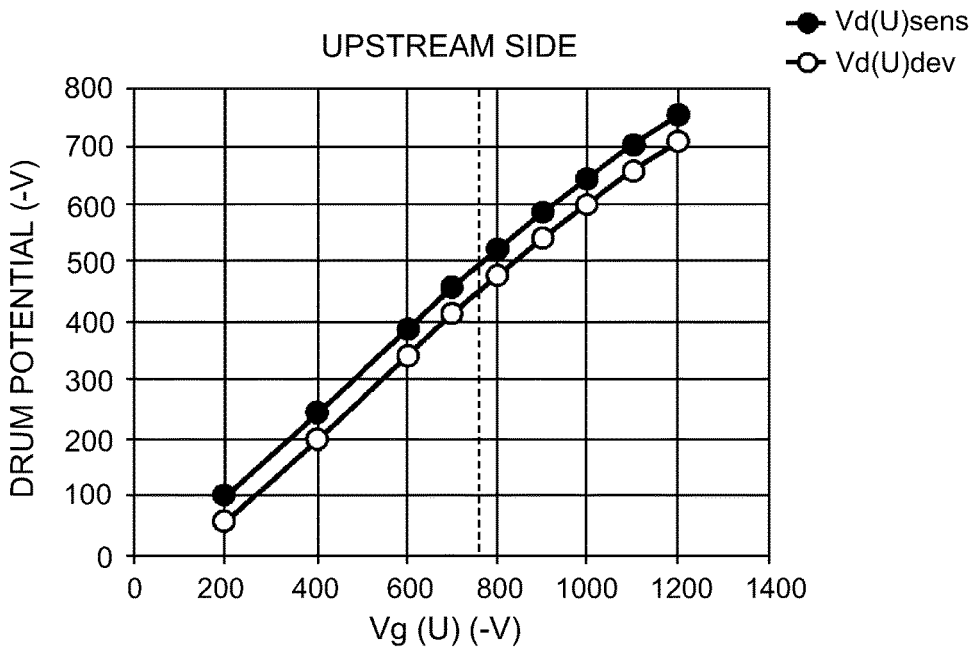

FIG. 6 is a graph for illustrating a charge potential formed by an upstream charger.

Figure 7:
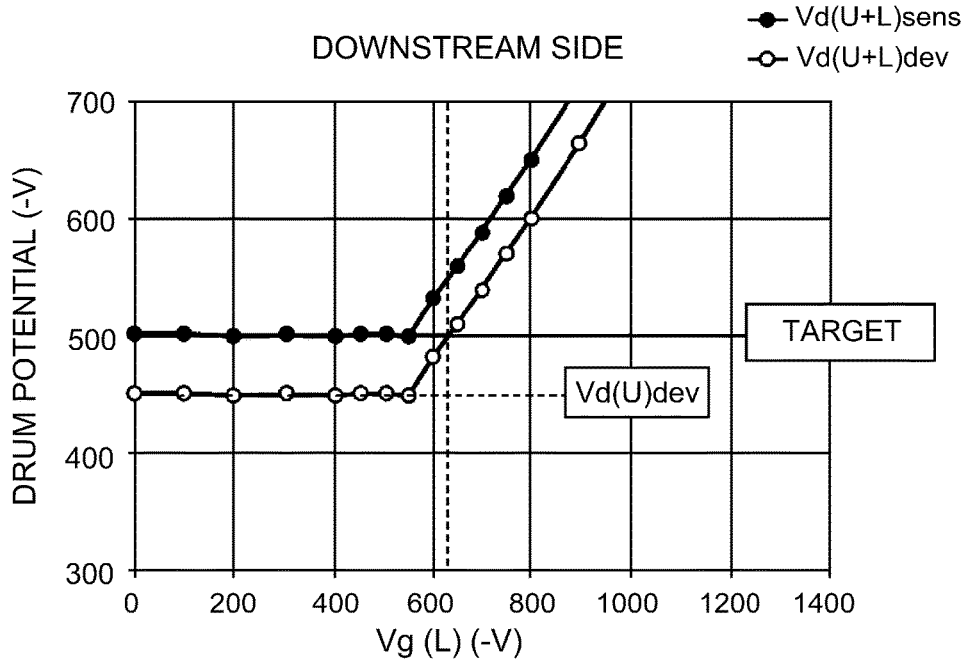

FIG. 7 is a graph for illustrating a charge potential formed by a downstream charger.

Figure 8:
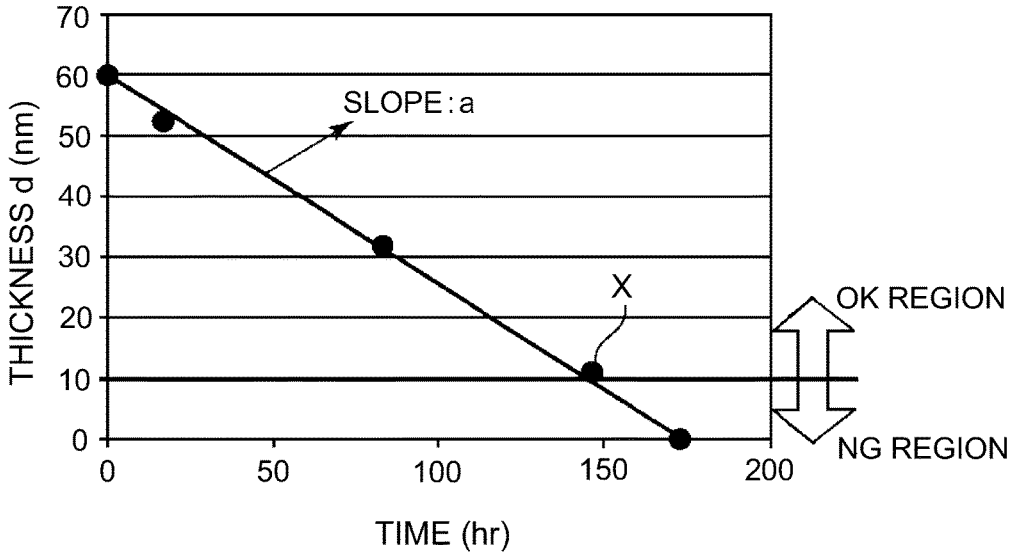

FIG. 8 is a graph showing a relationship between a charging time and a film thickness of a surface coating.

Figure 9:
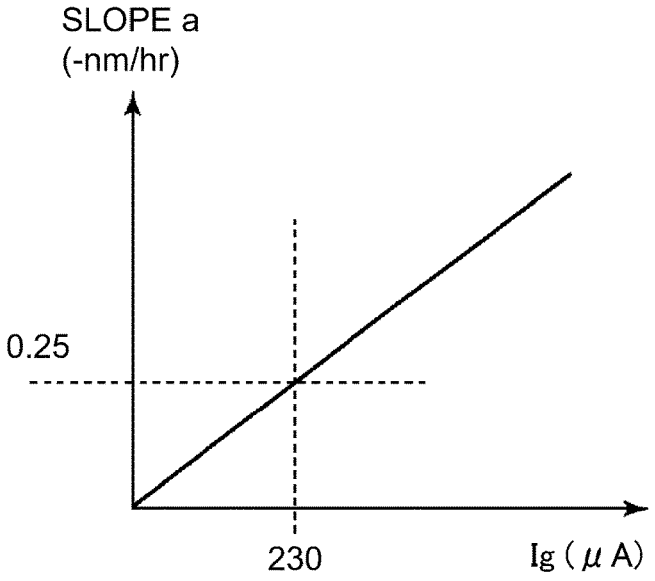
Figure 9:
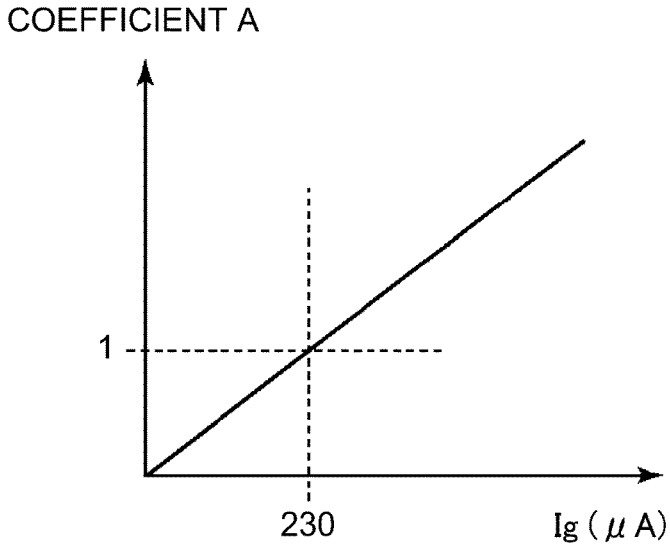

Part (a) of FIG. 9 is a graph showing a relationship between a grid current and a ratio of a change of the film thickness of the surface coating to the charging time, and part (b) of FIG. 9 is a graph showing a relationship between the grid current and a coefficient A.

Figure 10:
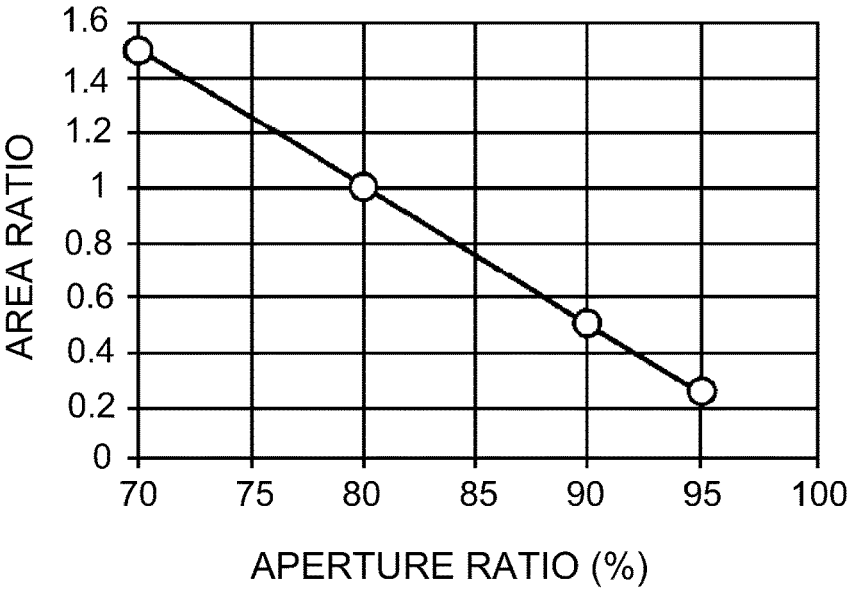
Figure 10:
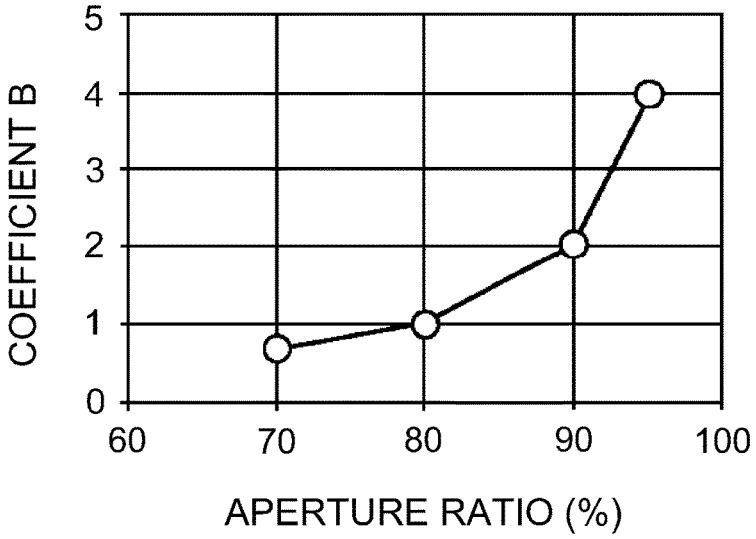

Part (a) of FIG. 10 is a graph showing a relationship between an aperture ratio of the grid electrode and an area ratio of the grid electrode, and (b) of FIG. 10 is a graph showing a relationship between the grid current and a coefficient B.

Figure 11:
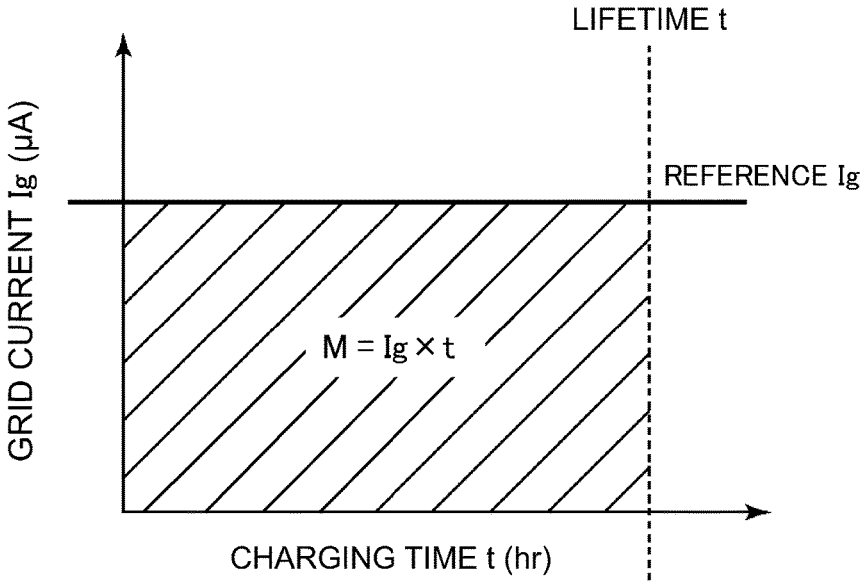

FIG. 11 is a graph for illustrating an amount of use (use amount) M of the grid electrode.

Figure 12:
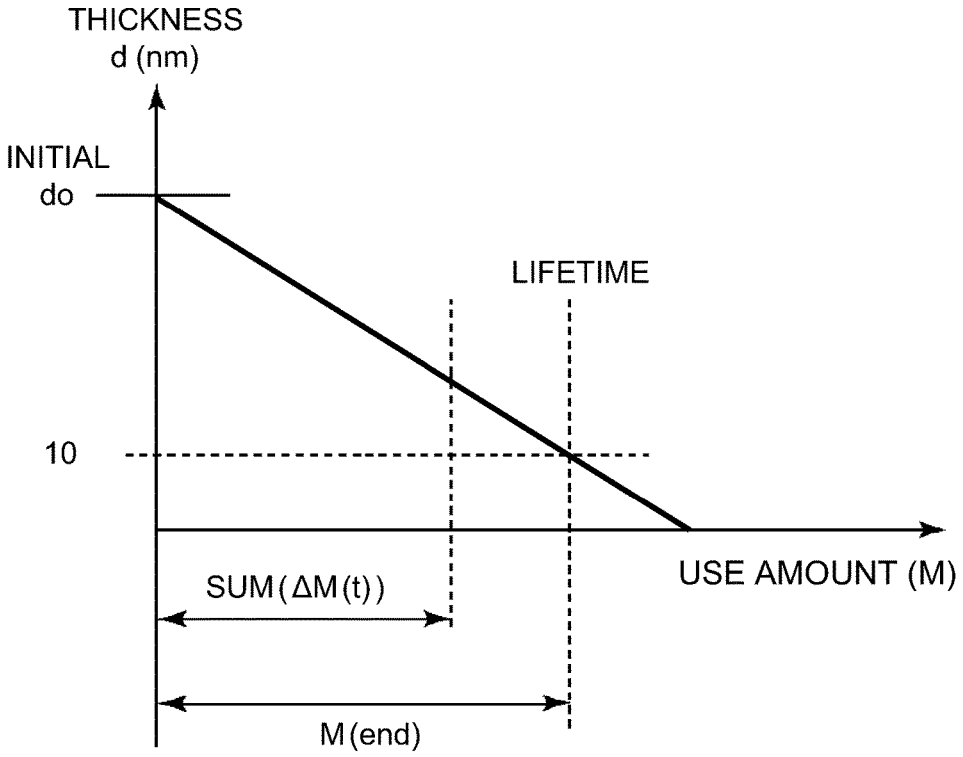

FIG. 12 is a graph showing a relationship between the amount of use M of the grid electrode and the film thickness of the surface coating.

Figure 13:
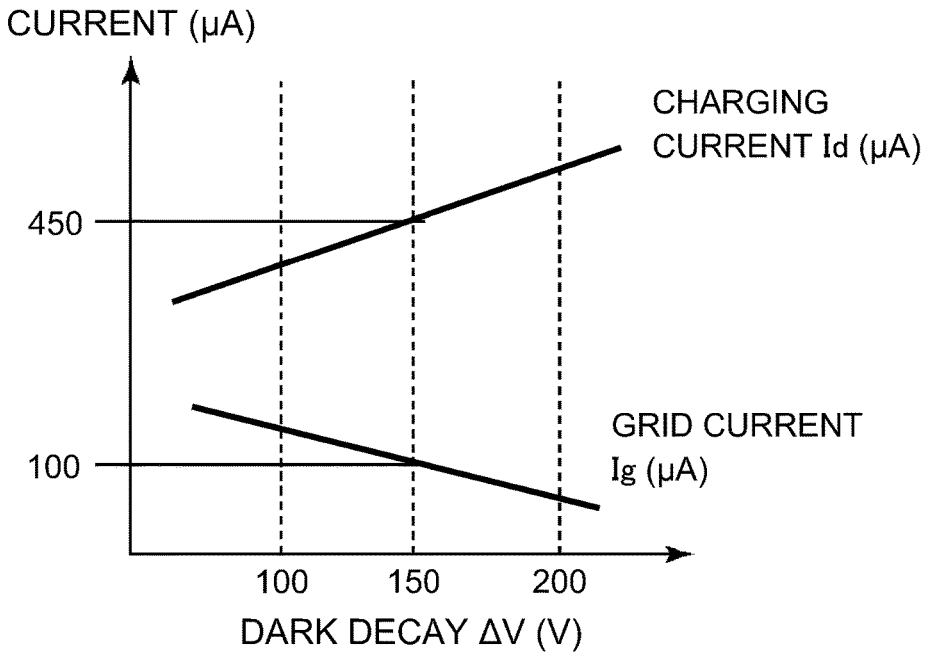
Figure 13:
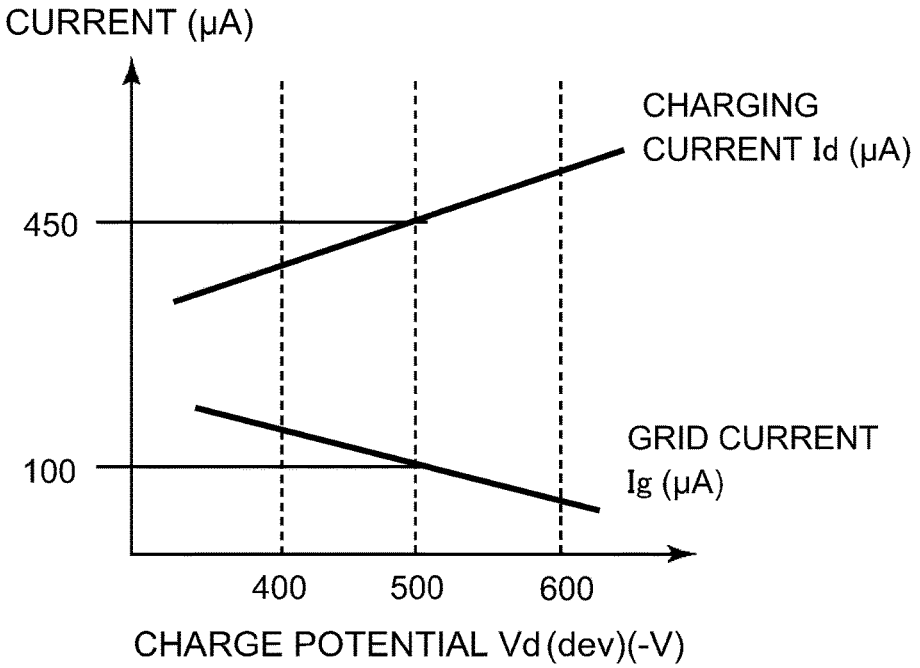

Part (a) of FIG. 13 is a graph showing a relationship between a dark decay amount of the photosensitive member and each of the grid current and a charging current, and part (b) of FIG. 13 is a graph showing a relationship between the charge potential and each of the grid current and the charging current.

Figure 14:
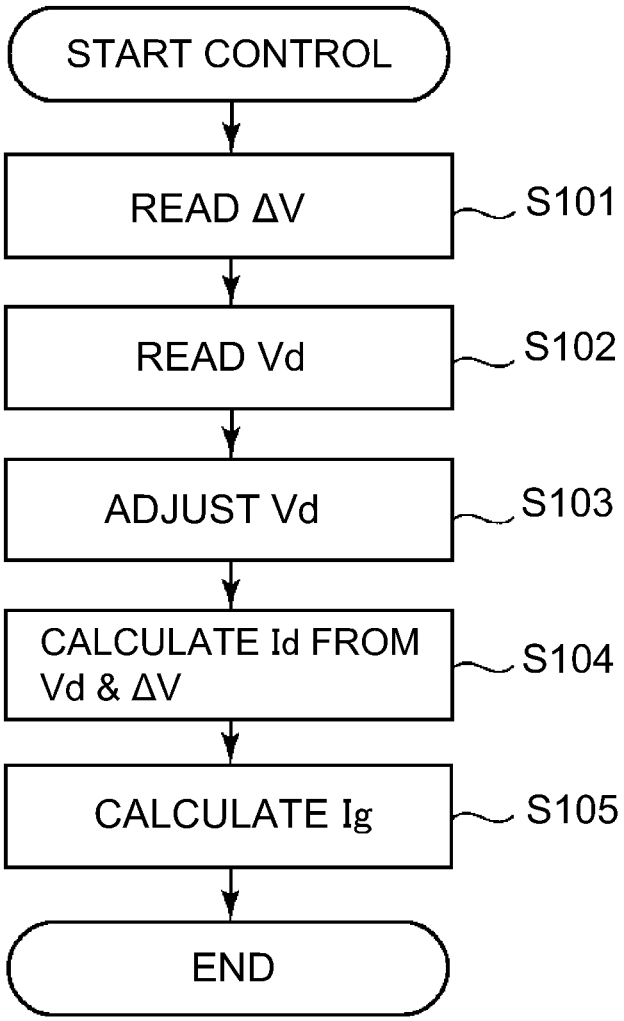

FIG. 14 is a flowchart of control of acquiring the grid current in Embodiment 1.

Figure 15:
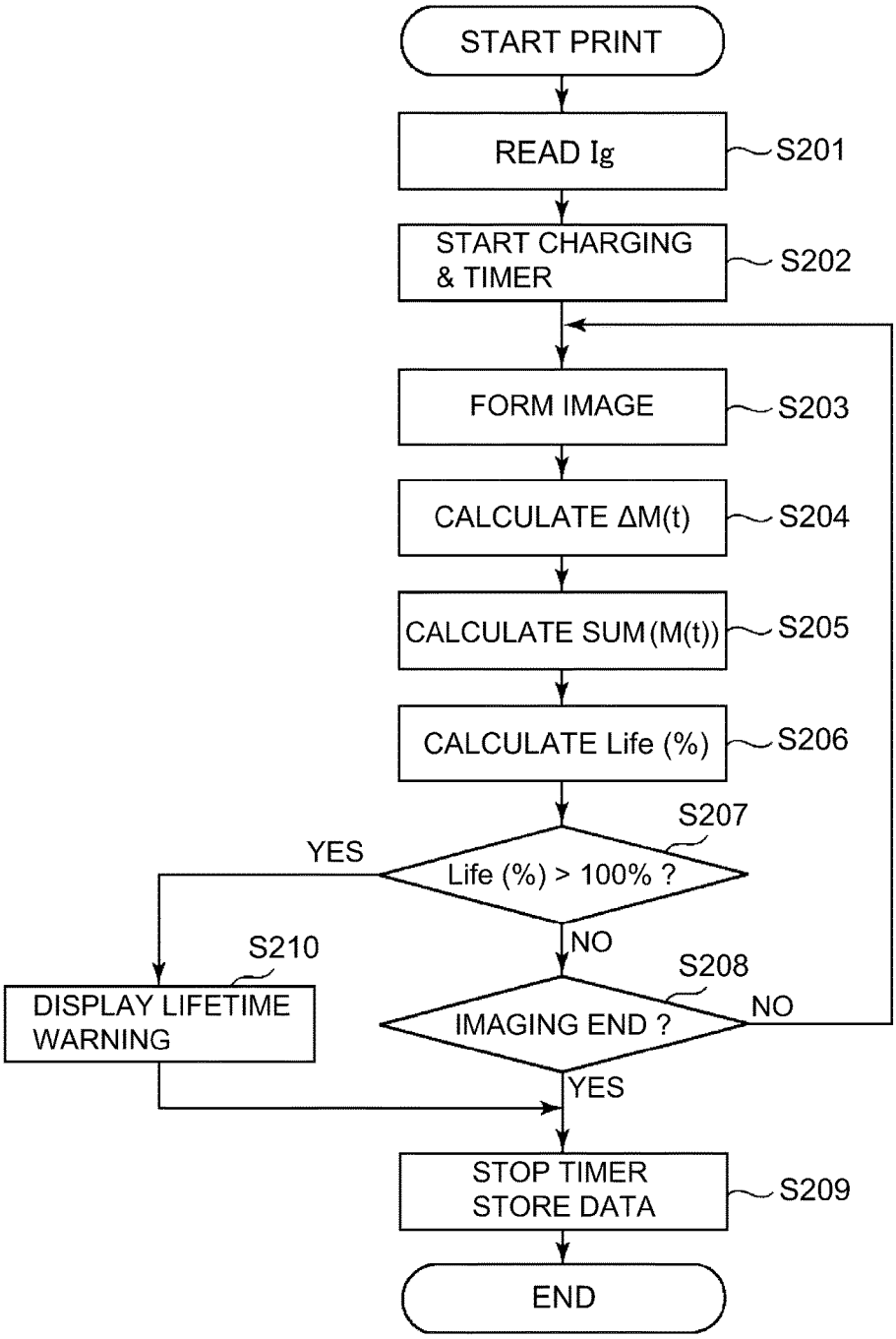

FIG. 15 is a flowchart of control of discriminating a lifetime of the grid electrode in Embodiment 1.

Figure 16:
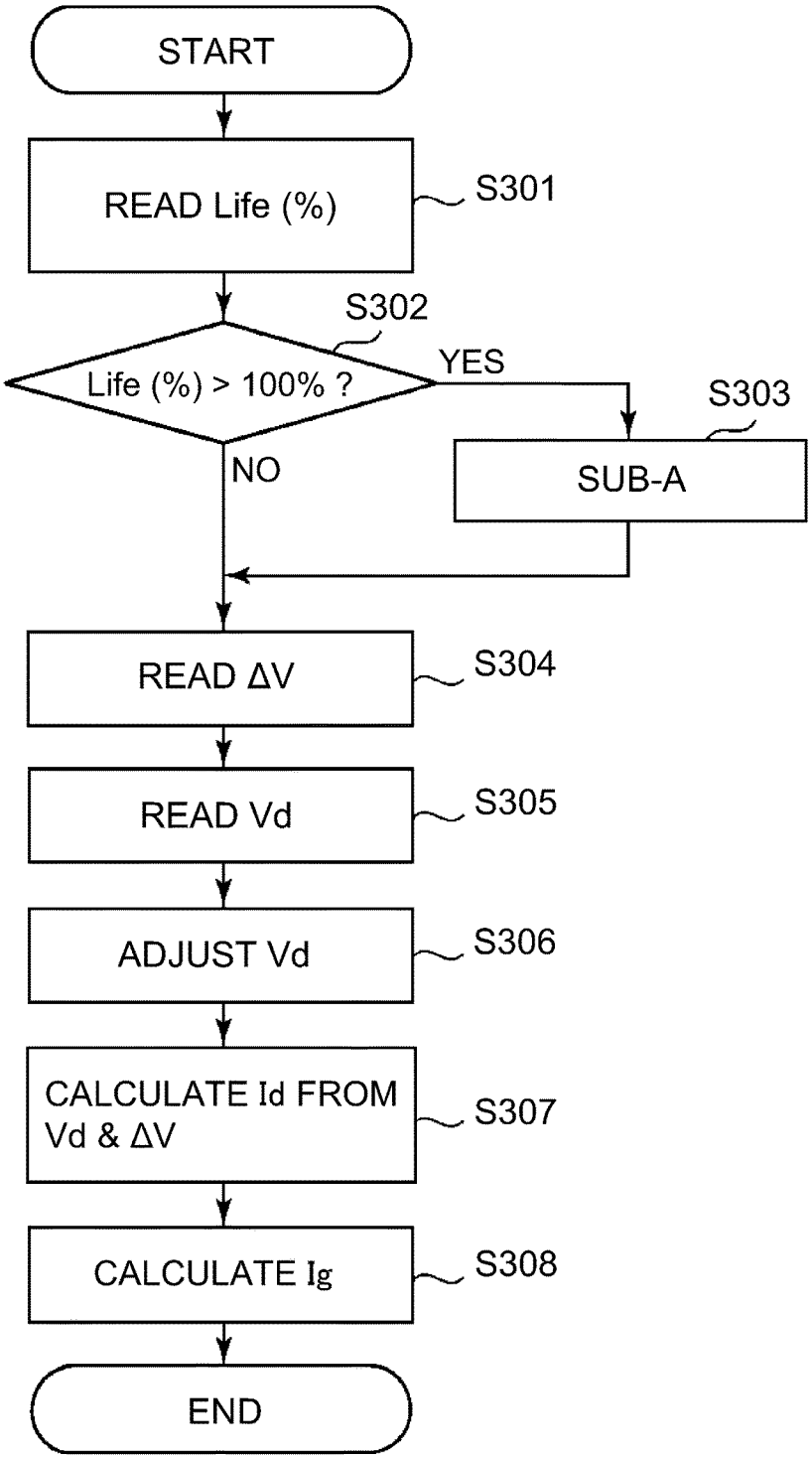

FIG. 16 is a flowchart of control of acquiring a grid current in Embodiment 2.

Figure 17:
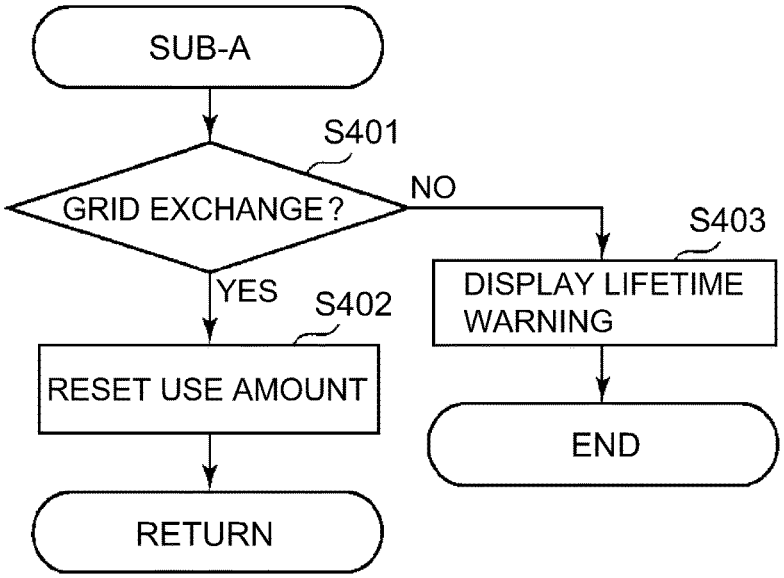

FIG. 17 is a flowchart of control of prompting an exchange of a grid electrode in Embodiment 2.

Figure 18:
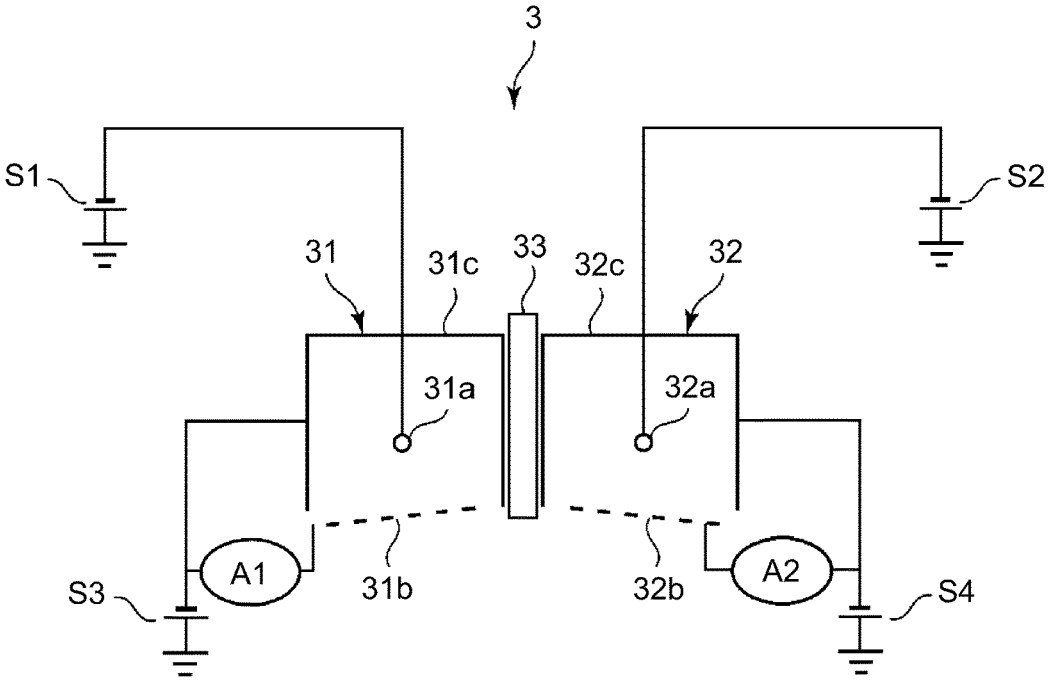

FIG. 18 is a schematic sectional view of a charging device in Embodiment 3.

Figure 19:
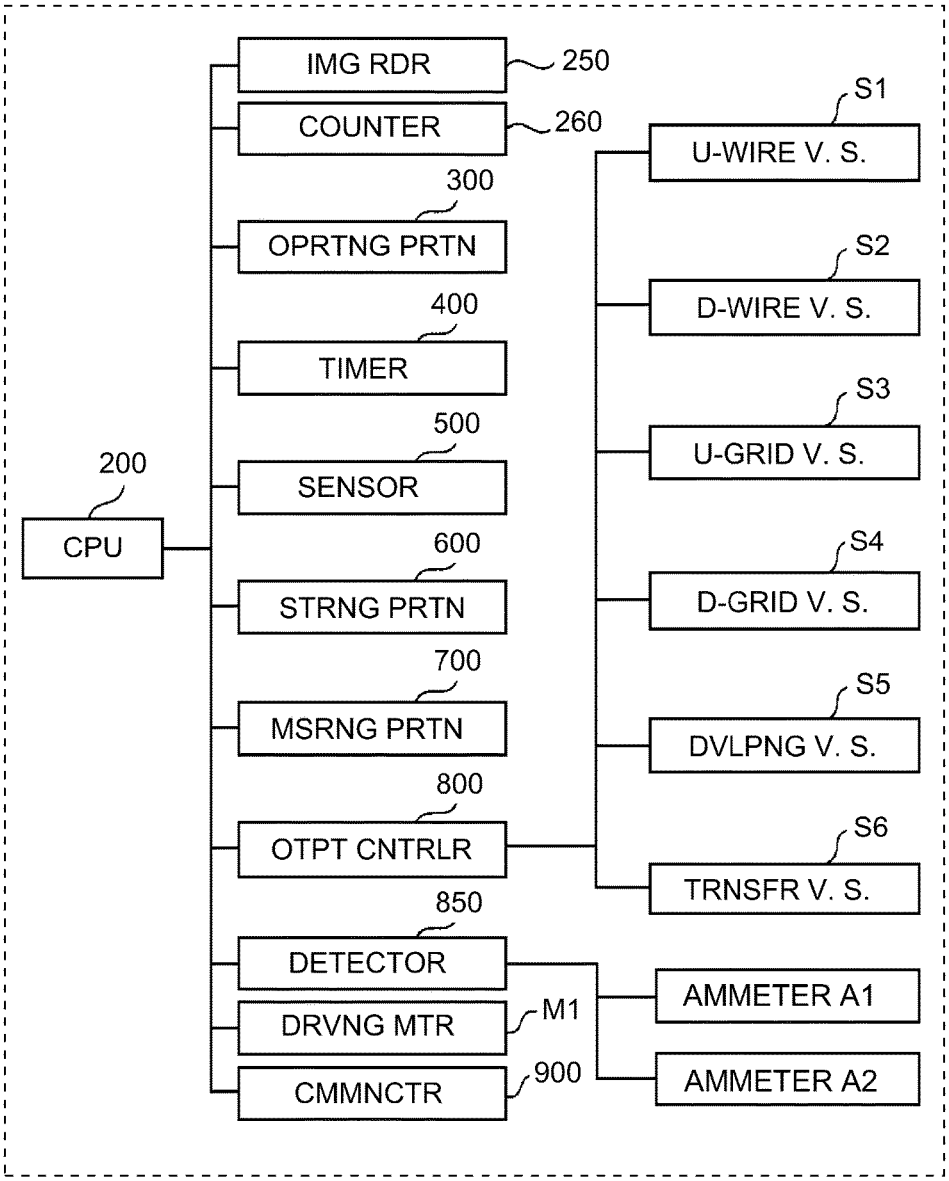

FIG. 19 is a schematic block diagram showing a control mode of a principal part of an image forming apparatus in Embodiment 3.

Figure 20:
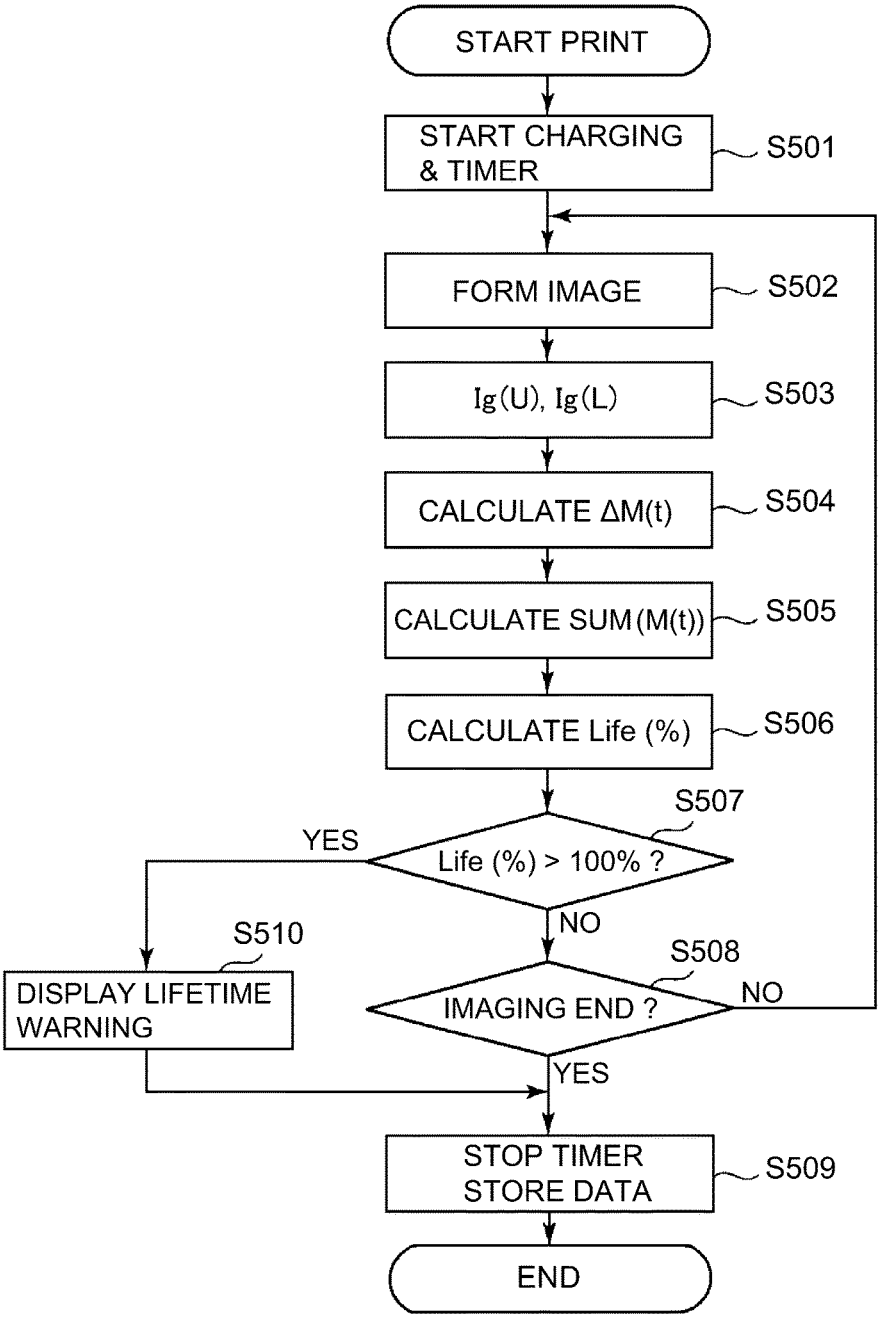

FIG. 20 is a flowchart of control of discriminating a lifetime of a grid electrode in Embodiment 3.

DESCRIPTION OF EMBODIMENTS

An image forming apparatus according to the present invention will be described specifically with reference to the drawings.

Embodiment 1

<1. Image Forming Apparatus>

<1-1. General Structure and Operation of Image Forming Apparatus>

Figure 1:
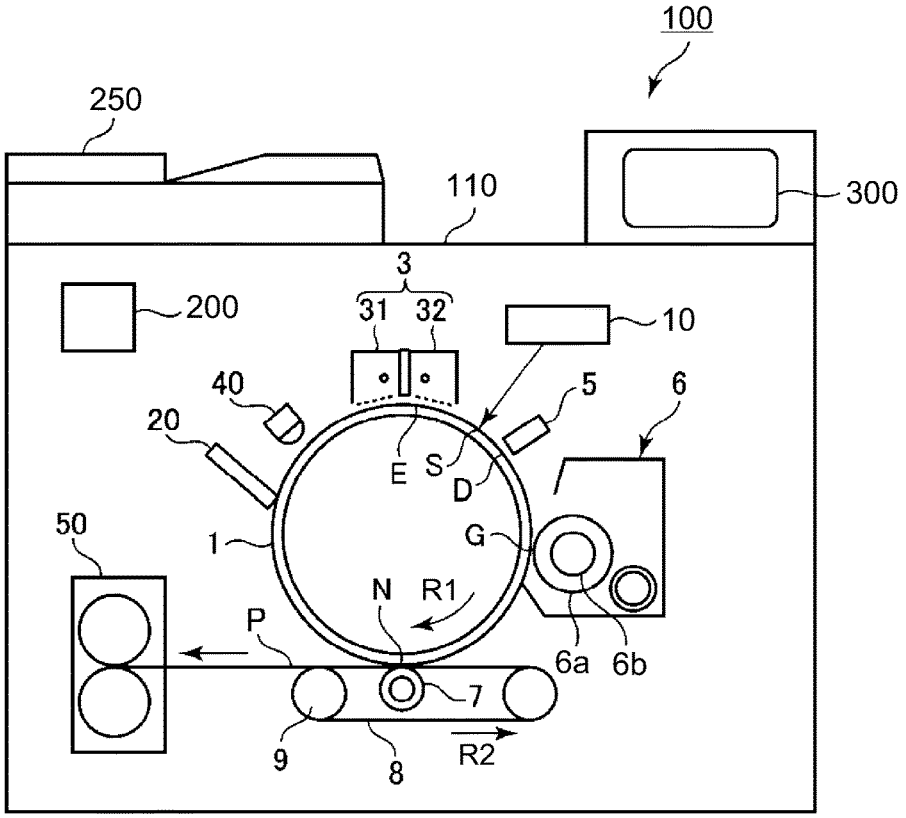
FIG. 1 is a schematic sectional view of an image forming apparatus.

FIG. 1 is a schematic sectional view of an image forming apparatus 100 in this embodiment.

The image forming apparatus 100 includes the photosensitive member 1 as an image bearing member. The photosensitive member 1 is rotationally driven in an arrow R1 direction (clockwise direction) in FIG. 1 at a predetermined peripheral speed (process speed). The surface of the rotating photosensitive member 1 is electrically charged to a predetermined polarity (negative in this embodiment) and a predetermined potential by a charging device 3 as a charging means. That is, the charging device 3 forms a charge potential (non-exposed portion potential, dark portion potential) on the surface of the photosensitive member 1. With respect to a rotational direction of the photosensitive member 1, a position where a charging procedure is carried out by the charging device 3 is a charging position E. The surface of the charged photosensitive member 1 is subjected to scanning exposure to light by a display device 10 as an exposure means depending on image information, and an electrostatic image (electrostatic latent image) is formed on the photosensitive member 1. In this embodiment, a wavelength of the light emitted from the exposure device 10 is 685 nm, and an exposure amount on the surface of the photosensitive member 1 by the exposure device 10 is variable in a range of 0.1-0.5 $\mu J/cm^2$. The exposure device 10 adjusts the exposure amount depending on a developing condition, so that a predetermined exposed portion potential (light portion potential) can be formed on the surface of the photosensitive member 1.

The electrostatic image formed on the surface of the photosensitive member 1 is developed (visualized) with toner as a developer by a developing device 6 as a developing means, so that a toner image is formed on the photosensitive member 1. In this embodiment, the developing device 6 employs a two-component developing type in which a two-component developer containing a carrier (magnetic carrier particles) and toner (non-magnetic toner particles) is used as the developer. The developing device 6 includes a developing sleeve 6*a*, having a hollow cylindrical shape, as a developer carrying member and a magnet roller 6*b*, provided inside (at a hollow portion of) the developing sleeve 6*a*, as a magnetic field generating means. The developing sleeve 6*a* carries the developer by a magnetic force generated by the magnet roller 6*b* and conveys the developer to a developing position G which is an opposing portion to the photosensitive member 1. During a developing step, to the developing sleeve 6*a*, a predetermined developing voltage (developing bias) is applied from a developing voltage source (high-voltage source) circuit S5 (FIG. 5).

In this embodiment, the photosensitive member surface is exposed to light after being charged, and thus an absolute value of the charge potential of the photosensitive member 1 lowers at an exposed portion of the photosensitive member 1, so that on the exposed portion, the toner is charged to the same polarity as the charge polarity (negative in this embodiment) of the photosensitive member 1 (reverse development).

The image forming apparatus 100 includes a potential sensor 5 as a potential detecting means for detecting the surface potential of the photosensitive member 1. The potential sensor 5 is provided so as to be capable of detecting the surface potential of the photosensitive member 1 at a detecting position (sensor position) D between an exposure position S on the photosensitive member 1 by the exposure device 10 and a developing position G by the developing device 6. Control using the potential sensor 5 will be described later.

A transfer belt 8 as a recording material carrying member is provided so as to oppose the photosensitive member 1. The transfer belt 8 is wound and stretched by a plurality of stretching rollers (supporting rollers), and of these stretching rollers, a driving force is transmitted by a driving roller 9, so that the transfer belt 8 is rotated (circulated and moved) in an arrow R2 direction (counterclockwise direction) shown in FIG. 1 at a peripheral speed which is the same as the peripheral speed of the photosensitive member 1. In an inner peripheral surface side of the transfer belt 8, at a position opposing the photosensitive member 1, a transfer roller 7 which is a roller-type transfer member as a transfer means is provided. The transfer roller 7 is pressed against the transfer belt 7 toward the photosensitive member 1 and thus forms a transfer portion N where the photosensitive member 1 and the transfer belt 7 are in contact with each other. As described above, the toner image formed on the photosensitive member 1 is transferred, at the transfer portion N, onto a recording material P such as paper fed and carried by the transfer belt 8. During a transfer step, to the transfer roller 7, a transfer voltage (transfer bias) of an opposite polarity (positive in this embodiment) to a charge polarity of the toner during the development is applied from a transfer voltage source (high voltage source circuit) S6 (FIG. 4).

The recording material P on which the toner image is transferred is fed to a fixing device 50 as a fixing means and is heated and pressed by the fixing device 50, so that the toner image is fixed (melt-fixed) on the surface of the recording material P, and thereafter, the recording material P is discharged (outputted) to an outside of an apparatus main assembly 110 of the image forming apparatus 100.

On the other hand, the toner (transfer residual toner) remaining on the photosensitive member 1 after the transfer step is removed and collected from the surface of the photosensitive member 1 by a cleaning device 20 as a cleaning means. The cleaning device 20 scrapes and collects the transfer residual toner from the surface of the rotating photosensitive member 1 by a cleaning member provided in contact with the surface of the photosensitive member 1.

The surface of the photosensitive member 1 after being cleaned by the cleaning device 20 is irradiated with light (discharging light) by a light (optical)-discharging device 40 as a discharging means, so that at least a part of residual electric charges is removed. In this embodiment, the light-discharging device 40 includes an LED chip array as a light source. In this embodiment, a wavelength of the light emitted from the light-discharging device 40 is 635 nm, and an exposure amount of the surface of the photosensitive member 1 by the light-discharging device 40 is variable in a range of 1.0-7.0 $\mu mJ/cm^2$. In this embodiment, an initial value of the exposure amount by the light-discharging device 40 is set at 4.0 $\mu J/cm^2$.

Operations of the respective portions of the image forming apparatus 100 is subjected to integrated control by a CPU 200 as a controller (control means) provided in the apparatus main assembly 110. The image forming apparatus 100 includes an operating portion 300 having a function as an input means for inputting various instructions and settings about a printing operation and a device adjusting operation and a function as a display means (means) for displaying various pieces of information. In this embodiment, the operating portion 300 is constituted by a touch-operable screen (touch panel). The image forming apparatus 100 further includes a reading portion 250 for optically reading an image on the medium such as paper and for permitting input to the CPU 200 after converting the read image into an electric signal.

<1-2. Photosensitive Member>

Figure 2:
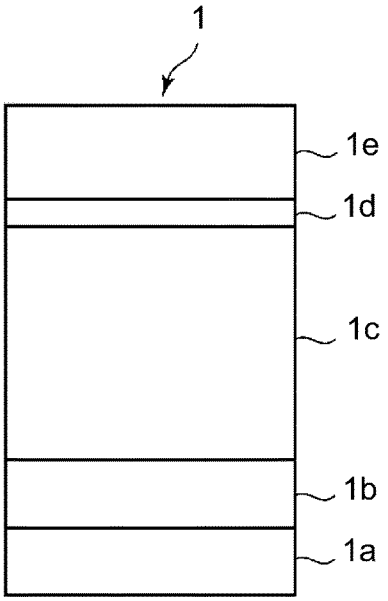
FIG. 2 is a schematic view for illustrating a layer structure of a photosensitive member.

FIG. 2 is a schematic sectional view showing a layer structure of the photosensitive member 1 in this embodiment. In this embodiment, the photosensitive member 1 is a cylindrical (drum-shaped) electrophotographic photosensitive member (photosensitive drum) and is rotatably supported by the apparatus main assembly 100, and is rotationally driven by a driving motor M1 (FIG. 4) as a driving means.

The photosensitive member 1 includes an electroconductive support 1*a* formed of aluminum or the like, and on this electroconductive support 1*a*, layers consisting of a prevention layer 1*b*, a photosensitive layer 1*c*, a prevention layer 1*d* and a protective layer 1*e* are laminated in a named order. In this embodiment, a charge polarity of the photosensitive member 1 is a negative (polarity). In this embodiment, the photosensitive member 1 is an amorphous silicon photosensitive member of 84 mm in diameter. Further, in this embodiment, the photosensitive layer 1*c* is 40 μm in film (layer) thickness and is 10 in relative dielectric constant.

Incidentally, the constitution of the photosensitive member 1 is not limited to that in this embodiment, but the present invention is also applicable to the case where an OPC (organic photoconductor (photosensitive member)) or a photosensitive member different in charge polarity from the photosensitive member of this embodiment is used.

<1-3. Charging Device>

Parts (a) and (b) of FIG. 3 are schematic sectional views of the charging device 3 in this embodiment. In this embodiment, the charging device 3 is disposed above the photosensitive member 1.

As shown in part (a) of FIG. 3, the charging device 3 includes, as a plurality of corona chargers, an upstream(-side) charger (first charger) 31 provided in an upstream side with respect to a surface movement direction of the photosensitive member 1 and a downstream(-side) charger (second charger) 32 provided in a downstream side with respect to the surface movement direction. The upstream charger 31 and the downstream charger 32 are disposed adjacent to each other along the surface movement direction of the photosensitive member 1. The upstream charger 31 and the downstream charger 32 are scorotron chargers and are constituted so that charge voltages (charging biases, high charge voltages) applied thereto are independently controlled. In the following, elements relating to the upstream charger 31 and the downstream charger 32 are distinguished from each other by adding prefixes "upstream" and "downstream" in some instances.

The upstream charger 31 and the downstream charger 32 include wire electrodes (discharging wires, discharging wires) 31*a* and 32*a* as discharging electrodes, grid electrodes 31*b* and 32*b* as control electrodes, and shield electrodes 31*c* and 32*c* as shielding members (casings), respectively. Further, between the upstream charger 31 and the downstream charger 32, an insulating plate 33, which is an insulating member formed of an electrically insulating material, is provided. As a result, when different voltages are applied to the upstream shield electrode 31*c* and the downstream shield electrode 32*c*, generation of leakage between the upstream shield electrode 31*c* and the downstream shield electrode 32*c* is prevented. The insulating plate 33 is constituted by a plate-like member that is about 2 mm in thickness with respect to an adjacent direction (surface movement direction of the photosensitive member 1) between the upstream shield electrode 31*c* and the downstream shield electrode 32*c*.

A width of the charging device 3 with respect to the surface movement direction of the photosensitive member 1 is 44 mm, and a length of a discharging region (region where discharge for permitting charge of the photosensitive member 1 can be generated) of the charging device 3 with respect to a longitudinal direction (rotational axis direction) of the photosensitive member 1 is 340 mm. A width of the discharging region of each of the upstream charger 31 and the downstream charger 32 with respect to the surface movement direction of the photosensitive member 1 is 20 mm, i.e., the same.

Each of the upstream wire electrode 31*a* and the downstream wire electrode 32*a* is a wire electrode constituted by an oxidized tungsten wire. As a material of the wire electrode, a material which is 60 μm in line diameter (diameter) and which is ordinarily used in the image forming apparatus of the electrophotographic type was employed. Each of the upstream wire electrode 31*a* and the downstream wire electrode 32*a* is disposed so that an axial direction thereof is substantially parallel to the rotational axis direction of the photosensitive member 1.

Each of the upstream grid electrode 31*b* and the downstream grid electrode 32*b* is a substantially flat plate-like grid electrode which is provided with a mesh-shaped opening formed by etching and which has a substantially rectangular shape elongated in one direction. As specifically described later, in this embodiment, each of the upstream grid electrode 31*b* and the downstream grid electrode 32*b* is constituted by providing a surface layer (surface coating) containing a carbon atom as a main component on a surface of a substrate (base material) formed of SUS (stainless steel). Each of the upstream grid electrode 31*b* and the downstream grid electrode 32*b* is disposed so that a longitudinal direction thereof is substantially parallel to the rotational axis direction of the photosensitive member 1.

Further, as shown in part (b) of FIG. 3, each of the upstream grid electrode 31*b* and the downstream grid electrode 32*b* is disposed by changing an arrangement angle (inclination angle) so that a planar direction thereof extends along curvature of the photosensitive member 1. The arrangement angle of each of the upstream grid electrode 31*b* and the downstream grid electrode 32*b* is substantially perpendicular to a rectilinear line connecting the associated one of the upstream grid electrode 31*b* and the downstream grid electrode 32*b* with a rotation center of the photosensitive member 1. Further, each of closest distances (gaps) g between the photosensitive member 1 and the upstream grid electrode 31*b* and between the photosensitive member 1 and the downstream grid electrode 32*b* is set in a range of 1.25±0.2 mm. Further, aperture ratio of the upstream grid electrode 31*b* and the downstream grid electrode 32*b* are set at 90% and 80%, respectively. Values of the aperture ratios are not limited to those in this embodiment, but may also be appropriately changed depending on, for example, a kind, a rotational speed, a charging condition, and the like of the photosensitive member 1.

Part (a) of FIG. 4 is a plan view of each of the upstream grid electrode 31*b* and the downstream grid electrode 32*b* (in this figure, only the upstream grid electrode 31*b* is illustrated as a representative). In this embodiment, a mesh shape of each of the grid electrodes 31*b* and 32*b* is such that a longitudinal direction of an opening of the grid electrode 31*b* (32*b*) is inclined by 45 degrees with respect to a longitudinal direction of the grid electrode 31*b* (32*b*) and that the opening is formed along the longitudinal direction of the grid electrode 31*b* (32*b*) with predetermined intervals (hatched line pitch). An isolated opening pitch (a width of the opening with respect to a direction perpendicular to the longitudinal direction) of the opening is set at 0.73 mm for the upstream grid electrode 31*b* and at 0.38 mm for the downstream grid electrode 32*b*.

Each of the upstream shield electrode 31*c* and the downstream shield electrode 32*c* is a substantially box-like member formed of an electroconductive material and is provided with an opening at a position opposing the photosensitive member 1. The upstream grid electrode 31*b* and the downstream grid electrode 32*b* are disposed at the openings of the upstream shield electrode 31*c* and the downstream shield electrode 32*c*, respectively.

<1-4. Surface Coating of Grid Electrode>

Part (b) of FIG. 4 of FIG. 4 is a schematic sectional view of each of the upstream grid electrode 31*b* and the downstream grid electrode 32*b* (in the figure, only the upstream grid electrode 31*b* is illustrated as a representative together with the upstream wire electrode 31*a*). In this embodiment, the surface coatings provided as the surface layers of the upstream grid electrode 31*b* and the downstream grid electrode 32*b* are substantially the same, and therefore, the upstream grid electrode 31*b* will be described as a representative.

As shown in part (b) of FIG. 4, on the surface of the substrate S, formed of SUS, of the grid electrode 31*b*, the surface coating C is provided. In this embodiment, a film thickness (thickness) d of the surface coating C provided on the surface of the substrate S in the wire electrode 31*a* side of the grid electrode 31*b* is set at 60±10 nm in an initial state of use (unused state) of the grid electrode 31*b*. In this embodiment, the film thickness of the surface coating C provided on a substantially entire surface, of the substrate S of the grid electrode 31*b*, including the surface in the photosensitive member 1 side and edges of the opening is substantially equal to the above-described film thickness.

In this embodiment, a volume resistivity of the surface coating C is about $10^8$-$10^{10}$ ohm·cm, and the surface coating has semiconductivity. In this embodiment, the surface coating C is formed of tetrahedral amorphous carbon (Ta—C). In this embodiment, a ratio (sp3:sp2), between sp3 structure and sp2 structure, showing a carbon composition of ta-C is 7:3.

The film thickness of the surface coating C can be set arbitrarily in consideration of a film-forming condition, the composition and the like of the surface coating C. However, the surface coating C has the semiconductivity, and therefore, when the film thickness thereof is made excessively large, the excessively large film thickness has an influence on a charging property of the photosensitive member 1. Accordingly, the film thickness of the surface coating C may preferably be in a range up to about several μm such that there is no influence on the charging property or the influence is negligible. A lower limit of the film thickness (at least the film thickness d of the surface in the wire electrode 31*a* side) of the surface coating C will be described later.

Incidentally, the composition of the surface coating C used in this embodiment is not a special one; a material which is called ta-C or diamond-like carbon (DLC) and which is used in general as the surface layer (coating material) of the grid electrode as disclosed in Japanese Patent No. 5414198 is used.

<1-5. Charge Voltage>

As shown in part (a) of FIG. 3, the upstream wire electrode 31*a* and the downstream wire electrode 32*a* are connected with an upstream wire voltage source S1 and a downstream wire voltage source S2, respectively, which are DC voltage sources (high voltage source circuits). As a result, voltages applied to the upstream wire electrode 31*a* and the downstream wire electrode 32*a* can be independently controlled. Further, the upstream grid electrode 31*b* and the downstream grid electrode 32*b* are connected with an upstream grid voltage source S3 and a downstream grid voltage source S4, respectively, which are DC voltage sources (high voltage source circuits). As a result, voltages applied to the upstream grid electrode 31*b* and the downstream grid electrode 32*b* can be independently controlled. In the following, the upstream wire voltage source S1, the downstream wire voltage source S2, the upstream grid voltage source S3 and the downstream grid voltage source S4 are collectively referred to as "charging voltage sources" in some cases. The charging voltage sources S1-S4 are examples of voltage applying means for applying voltages which can be independently controlled for the upstream charger 31 and the downstream charger 32, respectively.

The upstream shield electrode 31*c* and the downstream shield electrode 32*c* are connected with the upstream grid voltage source S3 and the downstream grid voltage source S4, respectively, and thus have the same potentials as those of the upstream grid electrode 31*b* and the downstream grid electrode 32*b*, respectively.

The upstream and downstream shield electrodes 31*c* and 32*c* are not limited to those having the same potentials as those of the upstream and downstream grid electrode 31*b* and 32*b*, respectively, but may also be electrically grounded by being connected with grounding electrodes of the apparatus main assembly 110. A constitution capable of independently controlling charge potentials formed on the surface of the photosensitive member 1 by the upstream charger 31 and the downstream charger 32 may only be required to be employed.

In this embodiment, the charging device 3 performs a charging process by forming a combined surface potential through superposition of charge potentials formed by independently controlling charging voltages applied to the upstream charger 31 and the downstream charger 32. In this embodiment, the upstream charger 31 is a main charging-side charger, and the downstream charger 32 is a potential convergence-side charger. As regards absolute values of the charge potentials of the photosensitive member 1 formed by the respective chargers, the absolute value for the upstream charger 31 is set so as to be larger than the absolute value for the downstream charger 32.

FIG. 5 is a block diagram showing a schematic control mode of a principal part of the image forming apparatus 100. To the CPU 200, a reading portion 250, a sheet number counter 260, an operating portion 300, a timer 400, an environment sensor 500, a storing portion 600, a surface potential measuring portion 700, a high voltage output controller 800 and the like are connected. The sheet number counter 260 counts the number of sheets (print number) subjected to image formation for each formation of the image on the recording material P. The timer 400 measures a time. The environment sensor 500 detects at least one of a temperature and a humidity of at least one of an inside and an outside of the apparatus main assembly 110. The surface potential measuring portion 700 is a control circuit for controlling an operation of the potential sensor 5 under control of the CPU 200. The high voltage output controller 800 is a control circuit for controlling operations of the charge voltage sources S1-S4, the developing voltage source S5 and the transfer voltage source S6 under control of the CPU 200. The storing portion 600 is a memory which is a storing means for storing programs and detection result of various detecting means, and stores, e.g., control data of the charge voltage and a measurement result of the surface potential of the photosensitive member 1. The CPU 200 carries out processes on the basis of the measurement result of the sheet number counter 260, the timer 400, the environment sensor 500 and information stored in the storing portion 600, and provides an instruction to the high voltage output controller 800, and thus controls the charge voltage sources S1-S4.

DC voltages applied to the upstream wire electrode 31*a* and the downstream wire electrode 32*a* (hereinafter, referred to as "wire voltages") are subjected to constant-current control so that values of currents flowing through the upstream wire electrode 31*a* and the downstream wire electrode 32*a* (hereinafter, referred to as "wire currents") are substantially constant at target current values. In this embodiment, the target current value of the wire current (primary current) is changeable in a range of 0 to −3200 μA. Further, DC voltages applied to the upstream grid electrode 31*b* and the downstream grid electrode 32*b* (hereinafter, referred to as "grid voltages") are subjected to constant-voltage control so that values of the voltages are substantially constant at target voltage values. In this embodiment, the target voltage value of the grid voltage is changeable in a range of 0 to −1200 V.

<2. Control of Charge Potential>

Then, control (adjustment) of the charge potentials Vd of the photosensitive member 1 by the charging device 3 will be further described.

As regards symbols or numerals showing the potentials, the voltages, the currents and the like, the symbols are distinguished from each other by adding "U" to the symbols relating to the upstream charger 31 and "L" to the symbols relating to the downstream charger 32, respectively, in some cases. Further, as regards the symbols showing the potentials, the potentials are distinguished from each other by adding "sens" to the symbols relating a sensor position D, "dev" to the symbols relating to the developing position G, and "charging position" to the symbols relating to the charging position E, respectively, with respect to the rotational direction of the photosensitive member 1 in some cases.

<2-1. Charge Potential by Upstream Charger>

First, control of an upstream charge potential Vd(U) which is the charge potential formed on the surface of the photosensitive member 1 by the upstream charger 31 will be described.

The upstream charge potential Vd(U) is controlled in the following manner. In a state in which an upstream wire voltage is applied to the upstream wire electrode 31*a* by the upstream wire voltage source S1 and thus a predetermined upstream wire current Ip(U) is supplied, an upstream grid voltage Vg(U) applied to the upstream grid electrode 31*b* by the upstream grid voltage source S3 is controlled (adjusted).

FIG. 6 shows a relationship of the upstream grid voltage Vg(U) with upstream charge potentials Vd(U)sens and Vd(U)dev at the sensor position D and the developing position G, respectively, in the case where the peripheral speed of the photosensitive member 1 is 700 mm/sec. As shown in FIG. 6, the upstream charge potentials Vd(U) vary depending on the upstream grid voltage Vg(U). For example, in the case where the upstream wire current Ip(U) is −1600 μA, when the upstream grid voltage Vg(U) is −750 V, the upstream charge potential Vd(U)sens at the sensor position D is −500 V, and the upstream charge potential Vd(U)dev at the developing position G is −450 V. In this embodiment, a dark decay amount of the photosensitive member 1 is about 50 V between the sensor position D and the developing position G. Accordingly, in this embodiment, in consideration of the dark decay amount of the photosensitive member 1, in order to set Vd(U)dev at a target potential (−450 V in this embodiment), the upstream grid Vg(U) is variably adjusted so that Vd(U)sens is −500 V. That is, the upstream charge potential Vd(U) and the target potential are compared with each other, and then an adjusting operation from increasing or decreasing a setting value of the upstream grid voltage Vg(U) is effected so that the upstream charge potential Vd(U) approaches the target potential. The CPU 200 causes the storing portion 600 to store the setting value of the upstream grid voltage Vg(U) adjusted as described above, and then uses the setting value during the charging process until a subsequent adjusting operation is performed.

<2-2. Charge Potential by Downstream Charger>

Next, control of a downstream charge potential Vd(L) which is the charge potential formed on the surface of the photosensitive member 1 by the downstream charger 32 will be described. The control of the downstream charge potential Vd(L) is carried out in a state in which the upstream charge potential Vd(U) is controlled (adjusted) as described above and then the charging operation by the upstream charger 31 is continued.

The downstream charge potential Vd(L) is controlled in the following manner. In a state in which a downstream wire voltage is applied to the downstream wire electrode 32*a* by the downstream wire voltage source S2 and thus a predetermined downstream wire current Ip(L) is supplied, a downstream grid voltage Vg(L) applied to the downstream grid electrode 32*b* by the downstream grid voltage source S4 is controlled (adjusted). As a result, the downstream charger 32 forms, on the surface of the photosensitive member 1, a combined surface potential Vd(U+L) in the form of the upstream charge potential Vd(U) superposed with the downstream charge potential Vd(L).

FIG. 7 shows a relationship between the downstream grid voltage Vg(L) and the combined surface potential Vd(U+L) at the sensor position D and the developing position G in the case where the upstream charge potential Vd(U) is superposed with the downstream charge potential Vd(L). For example, in the case where the upstream charge potential Vd(U)dev at the developing position G is −450 V, when the downstream wire current Ip(L) is −1600 μA and the downstream grid voltage Vg(L) is −620 V, the combined surface potentials are as follows. That is, the combined surface potential Vd(U+L)sens at the sensor position D is −550 V, and the combined surface potential Vd(U+L)dev at the developing position G is −500 V.

In this embodiment, in consideration of the dark decay amount of the photosensitive member 1, in order to set Vd(U+L)dev at a target potential (−500 V in this embodiment), the downstream grid Vg(L) is variably adjusted so that Vd(U+L)sens is −550 V. That is, the combined surface potential Vd(U+L) and the target potential are compared with each other, and then an adjusting operation from increasing or decreasing a setting value of the downstream grid voltage Vg(L) is effected so that the combined surface potential Vd(U+L) approaches the target potential. The CPU 200 causes the storing portion 600 to store the setting value of the downstream grid voltage Vg(L) adjusted as described above, and then uses the setting value during the charging process until a subsequent adjusting operation is performed.

In this embodiment, control of the charge potential Vd (specifically, adjustment of the setting values of the upstream grid voltage Vd(U) and the downstream grid voltage Vg(L)) (hereinafter, also referred simply to as "potential control") is carried out at predetermined timing during non-image formation. In this embodiment, as the predetermined timing, the potential control is carried out in the case where an integrated print number (sheet number) counted by the sheet number counter 260 reaches 5000 sheets, during actuation of the image forming apparatus and in the case where an environmental fluctuation of a predetermined value or more is detected by the environment sensor 500. Incidentally, "during non-image formation" is a period other than during an operation (printing operation) for performing the formation of the image to be transferred and outputted on the recording material P. As during non-image formation, it is possible to cite during a pre-multi-rotation operation, during a pre-rotation operation, during a sheet interval, during a post-rotation operation and the like. The pre-multi-rotation operation is a preparatory operation during main switch actuation of the image forming apparatus 100 or during restoration of the image forming apparatus 100 from a sleep state. The pre-rotation operation is an operation performed in a period, from input of an instruction of a start of a job until the image formation is actually started, in which a preparatory operation in advance of the image forming operation is carried out. The sheet interval is a period corresponding to an interval between a recording material P and a subsequent recording material P when images are continuously formed on a plurality of recording materials P (continuous image formation). The post-rotation operation is an operation performed in a period in which a post-operation (preparatory operation) after the image forming operation is carried out. Thus, the potential control is typically carried out automatically by the CPU 200, but may also be constituted so that the CPU 200 can carry out the control of the charge potential VD in response to an instruction from an operator through the operating portion 300. The job is a series of operations, started by a single start instruction, for forming and outputting the image(s) on a single recording material P or on the plurality of recording materials P.

<3. Change of Film Thickness of Surface Coating>

Next, the film thickness of the surface coating C of the grid electrodes 31*b* and 32*b*, particularly a change in film thickness d of the surface coating C provided on the surface of the grid electrodes 32*a* and 32*b* in the wire electrode 31*a* and 31*b* sides will be described. The reason why the change in film thickness d of the surface coating C on the surface in the wire electrode 31*a* and 31*b* sides is noted is that particularly the film thickness d of the surface coating C on this surface is liable to decrease with use of the charging device 3 more than the film thickness of other portions.

<3-1. Relationship Between Charging Time and Film Thickness Change>

FIG. 8 shows an example of a result of measurement of the change in film thickness d of the surface coating C with an increase in charging time (time in which the charging process of the photosensitive member 1 is performed) in the case where a discharging test of the downstream charger 32 is conducted alone. The film thickness d of the surface coating C at each of charging times was measured using ESCA (X-ray electron spectroscopy for chemical analysis). A value of the film thickness d is an average value of film thicknesses measured at a plurality of portions. Setting of the charging voltage was such that a wire current Ip(L) was −1000 μA and a grid voltage Vg(L) was −900 V. Particularly, FIG. 8 shows a measurement result in the case where a grid current Ig is 230 μA. The grid current Ig is a discharging current flowing into the grid electrode 32*b* and can be measured by connecting an ammeter between the grid electrode 32*b* and a grid voltage source S4.

As shown in FIG. 8, the film thickness d of the surface coating C decreases with the increase in charging time. Then, it turned out that when the film thickness d of the procedure C reaches 10 nm (plot X in FIG. 8), iron contained in SUS of the substrate S is oxidized and corroded. Further, it turned out that the decrease in film thickness d of the surface coating C generates conspicuously in the case where the negative discharging current flows into the grid electrode 32*b*. A detailed mechanism thereof is unclear, but it would be considered that the film thickness d of the surface coating C decreases with the increase in charging time due to connection of negative ions, containing oxygen atoms generated by negative electric discharge, with carbon atoms contained in the surface coating C, and when the film thickness d is a certain film thickness or less, the substrate S corrodes.

For that reason, in this embodiment, as shown in FIG. 8, setting was made so as to avoid use of the grid electrodes 31*b* and 32*b* for which the film thickness d of the surface coating C was 10 nm or less. This is because there is a possibility that by the generation of the corrosion of the substrates S of the grid electrodes 31*b* and 32*b*, stable discharge cannot be achieved and thus charging non-uniformity of the photosensitive member 1 generates. That is, in this embodiment, the time when the film thickness d of the surface coating C reached 10 nm was set as the ends of the lifetimes of the grid electrodes 31*b* and 32*b*.

<3-2. Influence of Grid Current>

As described above, in general, the film thickness d of the surface coating C decreases with the increase in charging time. Accordingly, it would be considered that by acquiring the relationship between the charging time and the film thickness d of the surface coating C in advance as shown in FIG. 8, the lifetimes of the grid electrodes 31*b* and 32*b* can be discriminated from the measurement result of the charging time. However, it turned out that a slope α of a rectilinear line showing the relationship between the charging time and the film thickness d of the surface coating C changes with the grid current Ig.

Part (a) of FIG. 9 shows a relationship between the slope α and the grid current Ig in the case where the discharging test of the downstream charger 32 was conducted alone similarly as in the case of FIG. 8. As shown in part (a) of FIG. 9, the slope α (−nm/hr) is proportional to the grid current Ig (μA).

Thus, a ratio (slope α) of the change in film thickness d of the surface coating C to the charging time changes depending on the grid current Ig. Further, the grid current Ig changes depending on the charging property (dark decay amount or the like) of the photosensitive member 1, charging voltage setting (setting of the charge potential, the wire current or the like) and the like. In the image forming apparatus 100, the charging property of the photosensitive member 1 is capable of changing depending on a difference among individuals of the photosensitive member 1 when the photosensitive member 1 is exchanged or in the like case. Further, in the image forming apparatus 100, the charging voltage setting is capable of changing due to a change in target value (set value) of the charge potential in order to meet an environmental change or to adjust an image density.

Part (b) of FIG. 9 shows a relationship between the grid current Ig and a coefficient A, wherein the abscissa represents the grid current Ig and the ordinate represents the coefficient A which is a ratio of the slope α to a value (−0.25 nm/hr) in the case where the grid current Ig is 230 μA. Specifically, as described later, in this embodiment, an index value (amount of use M described later) of an amount of use (use amount) of the grid electrode under a predetermined reference condition is corrected depending on the grid current Ig on the basis of the relationship between the grid current Ig and the coefficient A shown in part (a) of FIG. 9. Then, on the basis of the index value, discrimination of the lifetime of the grid electrode on the basis of a change amount of the film thickness d of the surface coating C is carried out.

In this embodiment, information showing the relationship between the grid current Ig and the coefficient A as shown in part (b) of FIG. 9 is acquired in advance and is stored in the storing portion 600. Then, the CPU 200 acquires the coefficient A corresponding to the grid current Ig on the basis of the information showing the relationship, between the grid current Ig and the coefficient A, stored in the storing portion 600.

Incidentally, a factor having an influence on the grid current Ig and a calculating method of the grid current Ig will be described sequentially. Further, as regards the discrimination of the lifetime of the grid electrode by using the coefficient A, detailed description will be made after an influence of the aperture ratio of the grid electrode on the lifetime of the grid electrode is described.

<3-3. Influence of Charging Property of Photosensitive Member>

The influence of the charging property of the photosensitive member 1 on the grid electrode will be described. A difference in charging property of the photosensitive member 1 generates due to principally a difference in dark decay amount of the photosensitive member 1. Part (a) of FIG. 13 shows an example of a relationship between the dark decay amount of the photosensitive member 1 between the charging position E of the downstream charger 32 and the developing position G and each of the charging current Id and the grid current Ig. Incidentally, the charging current Id is the discharge current flowing into the photosensitive member 1 and can be measured by connecting the ammeter between the photosensitive member 1 and the ground.

As shown in part (a) of FIG. 13, when the dark decay amount of the photosensitive member 1 increases, the charging current Id increases, and therefore the grid current Ig decreases.

Incidentally, part (a) of FIG. 13 shows the relationship between the dark decay amount of the photosensitive member 1 by the upstream charger 31 and each of the charging current Id and the grid current Ig of the upstream charger 31, but also as regards the downstream charger 32, a similar relationship between the dark decay amount of the photosensitive member 1 and each of the charging current Id and the grid current Ig holds.

<3-4. Influence of Charge Potential of Photosensitive Member>

The influence of the charge potential of the photosensitive member 1 on the grid current will be described. Part (b) of FIG. 13 shows an example of a relationship between a charge potential Vd(dev) at the developing position G and each of the charging current Id and the grid current Ig in the case where the discharging test of the upstream charger 31 is conducted alone.

In the charging device 3 in this embodiment, in the case where the charge potential of the photosensitive member 1 is changed, the wire current (primary current) is fixed, and the grid voltage Vg is changed. For that reason, as shown in part (b) of FIG. 13, when an absolute value of the charge potential Vd(dev) is increased by changing the grid voltage Vg, the charging current Id increases and the grid current Ig decreases.

Incidentally, part (b) of FIG. 13 shows the relationship between the charge potential of the photosensitive member 1 by the upstream charger 31 and each of the charging current Id and the grid current Ig of the upstream charger 31, but also as regards the downstream charger 32, a similar relationship between the charge potential of the photosensitive member 1 and each of the charging current Id and the grid current Ig holds.

<3-5. Calculating Method of Grid Current>

A calculating method of the grid current Ig in this embodiment will be described. In this embodiment, the grid current Ig is calculated using the following formulas (1) to (4).

$$Vd\ (\text{charge potential}) = Vd(\text{dev}) + \Delta V\ (\text{dark decay amount}) \quad (1)$$

$$Id = (\varepsilon d \times \delta o/dp) \times PS \times L \times Vd\ (\text{charge potential}) \quad (2)$$

$$Is = (IP - Id) \times [2S/(2S+W)] \quad (3)$$

$$Ig = Ip - (Is + Id) \quad (4)$$

In the above, εd is a dielectric constant (of the photosensitive layer in this embodiment) of the photosensitive member 1, εo is vacuum dielectric constant, $d_D$ is the film thickness (of the photosensitive layer in this embodiment) of the photosensitive member 1, PS is a peripheral speed, L is a longitudinal charging width (length of a discharging region) of the corona charger, S is an area of a shield electrode, and W is a widthwise of the grid electrode.

The above-described formula (1) is a formula for calculating the charge potential Vd (charging position) in the charging position E by using a target value (set value) of the charge potential Vd(dev) in the developing position G and ΔV (dark decay amount) which is the dark decay amount, from the charging position E to the developing position G, showing the charging property of the photosensitive member 1. The above-described formula (2) is a formula for calculating the charging current Id, which is the discharging current flowing into the photosensitive member 1 at the charging position E, by using the charge potential Vd (charging position) calculated by the above-described formula (1). The above-described formula (3) is a formula for calculating the shield current Is, which is the discharging current flowing into the shield electrode, on the basis of an area ratio between the grid electrode and the shield electrode. The above-described formula (4) is a formula for calculating the grid current Ig, which is the discharging current flowing into the grid electrode, by using the currents Is and Id calculated by the above-described formulas (2) and (3). In this embodiment, in the above-described formulas (1) to (4), Vd(dev) is changed in some cases when the potential control is carried out in order to meet the environmental change or to adjust the image density, and ΔV (dark decay amount) changes depending on the difference among individuals in some instances in the case where the photosensitive member 1 is exchanged or in the like case. Further, in this embodiment, in the above-described formulas (1) to (4), the values εd, $d_D$, PS, L, S and W are determined depending on the constitution of the image forming apparatus 100 (charging device 3).

In this embodiment, when the photosensitive member 1 is exchanged, information on ΔV (dark decay amount) as information on the charging property of the photosensitive member 1 is inputted through the operating portion 300 by the operator such as the user or the maintenance person of the image forming apparatus 100, and then is stored in the storing portion 600 by the operator. Further, in this embodiment, the target value (set value) of Vd(dev) during the potential control is stored in the storing portion 600. The CPU 200 calculates the grid current Ig in accordance with the above-described formulas (1) to (4) by using ΔV (dark decay amount) and Vd(dev) which are stored in the storing portion 600.

Incidentally, in this embodiment, the grid current Ig is calculated using the above-described formulas (1) to (4), but this method is an example of methods for acquiring the grid current Ig, and the present invention is not limited thereto. For example, a method in which a relationship among the dark decay amount ΔV (dark decay amount), Vd (charging position), Id and Ig is measured empirically in advance (this corresponds to acquirement of the relationship of part (b) of FIG. 13 for each of the dark decay amounts) and then is stored as table data in the storing portion 600 may also be employed. That is, a specific method as acquiring the grid current Ig can be appropriately changed depending on the constitution of the image forming apparatus 100 (charging device 3) or the condition of the charging voltage when the method is a method capable of discriminating the relationship between the grid current Ig and the change in film thickness d of the surface coating C.

<3-6. Influence of Aperture Ratio of Grid Electrode>

As described above, the ratio (slope α) of the change in film thickness d of the surface coating C to the charging time changes depending on the grid current Ig (FIGS. 8 and 9). Further, the factor having the influence on the grid current Ig and the calculating method of the grid current Ig were described. On the other hand, even when the grid currents are the same, the aperture ratios of the grid electrodes 31*b* and 32*b* have the influence on the lifetimes of the grid electrodes 31*b* and 32*b*. In this embodiment, the lifetimes of the grid electrodes are discriminated also in consideration of a difference in aperture ratio between the grid electrodes 31*b* and 32*b*.

Part (a) of FIG. 10 shows an example of a relationship in an entire longitudinal region of the grid electrode between the aperture ratio and a ratio (area ratio) of the opening to an area (of portions other than the opening) of the grid electrode in the case where the aperture ratio is 80%. Particularly, part (a) of FIG. 10 shows the relationship between the aperture ratio and the area ratio in the case where mesh shapes of the grid electrodes are all the same as those in this embodiment and a pitch of an isolated opening width is changed.

As shown in (a) of FIG. 10, the area of the grid electrode decreases with an increase in aperture ratio. As a result, in the case where some setting of the grid current is made, a density per unit area of the grid current increases with a decrease in area of the grid electrode. For that reason, even when the grid currents are the same, the influence of the grid current on the lifetime of the grid electrode increases with an increase in reciprocal (inverse) of the above-described area ratio.

Part (b) of FIG. 10 shows a relationship, between the aperture ratio and a coefficient B, determined on the basis of the relationship between the aperture ratio and the area ratio of part (a) of FIG. 10, wherein the abscissa represents the aperture ratio and the ordinate represents the coefficient B which is the reciprocal of the area ratio. Part (b) of FIG. 10 shows that under the same grid current condition, the change amount of the film thickness d of the surface coating C increases when the aperture ratio of the grid electrode is increased. In this embodiment, the index value (amount of use M described later), of the grid electrode, acquired depending on the grid current Ig as described above is corrected depending on the aperture ratio on the basis of the relationship between the aperture ratio of the grid electrode and the coefficient B shown in part (b) of FIG. 10. Then, on the basis of the index value, the lifetime of the grid electrode based on the change amount of the film thickness d of the surface coating C is discriminated.

In this embodiment, the information showing the relationship between the aperture ratio and the coefficient B as shown in part (b) of FIG. 10 is acquired in advance and then is stored in the storing portion 600. Further, the CPU 200 acquires the coefficient B corresponding to the aperture ratio of the grid electrode on the basis of the information, showing the relationship between the aperture ratio and the coefficient B, stored in the storing portion 600.

Incidentally, the discrimination of the lifetime of the grid electrode by using the coefficient B will be described below.

<4. Discrimination of Lifetime of Grid Electrode>

Next, a discriminating method of the lifetimes of the grid electrodes 31*b* and 32*b* in this embodiment will be described.

<4-1. Amount of Use of Grid Electrode>

The amount of use M which is the index value of the amount of use of the grid electrode will be described. FIG. 11 is a graph showing the amount of use M of the grid electrode under a predetermined reference condition. In FIG. 11, the abscissa represents the charging time t (hr), and the ordinate represents the grid current Ig (μA). In the figure, a hatched region shows the amount of use M of the grid electrode. In this embodiment, the amount of use M, of the grid electrode, which is the hatched portion is calculated using the following formula (5).

$$M = t \times Ig(\text{BASE}) \text{ (unit: } \mu A \times t) \quad (5)$$

In the formula (5), t is the charging time, and Ig(BASE) is the grid current under the predetermined reference condition.

In this embodiment, as described later, the lifetime of the grid electrode is discriminated using the relationship between the film thickness d of the surface coating C and an integrated value of the amount of use M under the predetermined reference condition shown in the formula (5). In this embodiment, the reference condition was such that the aperture ratio of the grid electrode was 80% and the grid current Ig(BASE) was 230 μA.

<4-2. Setting of Lifetime of Grid Electrode>

FIG. 12 is a graph showing a relationship between the amount of use (use amount) M of the grid electrode and the film thickness d of the surface coating C, wherein the abscissa represents the amount of use M of the grid electrode, and the ordinate represents the film thickness d of the surface coating C.

As shown in FIG. 12, when the amount of use M of the grid electrode increases, the film thickness d of the surface coating C decreases from a film thickness (initial film thickness) d0 of the grid electrode in an initial state of use. In this embodiment, as described above, the time when the film thickness d of the surface coating C reached 10 mm was set at the end of the lifetime of the grid electrode. For that reason, in this embodiment, an integrated value (M (end) described later) of the amount of use M when the film thickness d of the surface coating C reached 10 nm under the reference condition is used for discriminating the end of the lifetime of the grid electrode.

Incidentally, the value of the film thickness d, of the surface coating C, set as the (end of the) lifetime of the grid electrode is not limited to the value in this embodiment. This value can also be approximately set depending on the material of the substrate of the grid electrode, the film thickness in which the image defects starts to generate due to the corrosion of the substrate when the film thickness d of the surface coating C decreases, and the like.

<4-3. Lifetime Ratio of Grid Electrode>

A calculating method of a lifetime ratio used for discriminating the (end of the) lifetime of the grid electrode in this embodiment will be described. In this embodiment, in order to discriminate the lifetime of the grid electrode, the lifetime ratio of the grid electrode is calculated using the formulas (6) to (8).

$$\Delta M(t)=A\times Ig(\mathrm{BASE})\times\Delta t\times B \quad (6)$$

$$M(\mathrm{end})=Ig(\mathrm{BASE})\times t(\mathrm{BASE}) \quad (7)$$

$$\mathrm{Life}\ (\%)=\{\mathrm{SUM}(\Delta M(t))/M(\mathrm{end})\}\times 100 \quad (8)$$

Here, in the formula (6), Δt is the charging time under a present condition of the grid current Ig and the aperture ratio of the grid electrode, and a coefficient A is a ratio of a slope α at the grid current Ig in a period of Δt to a slope α, at a grid current Ig(BASE) (230 μA in this embodiment) under the reference condition, acquired depending on the grid current Ig on the basis of the relationship of part (b) of FIG. 9. Incidentally, in the case where the slope α (a ratio of the change in film thickness d of the surface coating C to the charging time) is proportional to the grid current Ig, the coefficient A may also be a ratio of the grid current Ig in the period of Δt to the grid current under the reference condition. Further, in the above-described formula (6), a coefficient B is a ratio of the influence at the aperture ratio in the period of Δt to the influence of the grid current on the lifetime of the grid electrode in the case where the aperture ratio (80%) under the reference condition acquired depending on the aperture ratio of the grid current on the basis of the relationship of part (b) of FIG. 10. Further, in the above-described formula (6), t(BASE) is the charging time until the film thickness d of the surface coating C at the grid current Ig(BASE) under the reference condition reaches 10 nm set as the lifetime thereof.

The above-described formula (6) is a formula for calculating an integrated value of the amount of use M of the grid electrode under the present condition of the grid current Ig and the aperture ratio of the grid electrode. The above-described formula (7) is a formula for calculating the integrated value M(end) of the amount of use of the grid electrode until the lifetime of the surface coating C at the grid current Ig(BASE) under the reference condition reaches 10 nm set as the lifetime of the surface coating C. The above-described formula (8) is a formula for calculating a lifetime ratio Life (%), of the grid electrode, which is a ratio of an integrated value SUM(ΔM(t)) of the amount of use M(t) of the grid electrode until now to an integrated value M(end) of the amount of use when the grid electrode reached the end of the lifetime thereof.

In this embodiment, by comparing the present lifetime ratio Life (%) of the grid electrode with a predetermined threshold (for example, 100%), arrival of the grid electrode at the end of the lifetime of the grid electrode or approach of lifetime of the grid electrode to the end of the lifetime of the grid electrode is discriminated.

<5. Control Procedure>

Next, a procedure of control relating to the discrimination of the lifetime of the grid electrode in this embodiment will be described.

In this embodiment, the charging device 3 includes the upstream charger 31 including the upstream grid electrode 31*b* having the aperture ratio of 90% and includes the downstream charger 32 including the downstream grid electrode 32*b* having the aperture ratio of 80%. In this embodiment, the lifetime of the upstream grid electrode 31*b* is discriminated, and then the upstream grid electrode 31*b* and the downstream grid electrode 32*b* are exchanged at the same time. This is because as is understood from part (b) of FIG. 10, there is a tendency that the upstream grid electrode 31*b* having a relatively large aperture ratio is larger in decrease ratio of the film thickness d of the surface coating C to the charging time than the downstream grid electrode 32*b* having a relatively small aperture ratio. Thus, in the case of the charging device 3 including the plurality of grid electrodes different in aperture ratio, the discrimination of the lifetime of the grid electrode can be carried out using, as a reference electrode, the grid electrode having the relatively large aperture ratio (typically the largest aperture ratio). As a result, it becomes possible to exchange the plurality of grid electrodes at proper timing before the image defect generates. Further, in the case of the charging device 3 including the plurality of grid electrodes different in charging performance (absolute value of the charge potential formed on the photosensitive member), the discrimination of the lifetime of the grid electrode can be carried out using, as a reference electrode, the grid electrode having a relatively high charging performance (typically the highest charging performance). That is, the discrimination can be made on the basis of the grid electrode of the charging by which the absolute value of the charge potential formed on the photosensitive member is relatively large (typically largest). This is because there is a tendency that the decrease ratio of the surface coating C to the charging time in the case of the grid electrode of the corona charger having the relatively high charging performance is larger than that in the case of the grid electrode of the corona charger having the relatively low charging performance.

<5-1. Procedure of Acquiring Value of Grid Current Ig>

First, by using a flowchart of FIG. 14, a procedure of acquiring a value of the grid current Ig used in calculation of the amount of use M of the upstream grid electrode 31*b* will be described. In this embodiment, as an example, a procedure during actuation of the image forming apparatus 100 will be described.

When the image forming apparatus 100 is actuated, the CPU 200 executes not only the potential control but also control of acquiring the value of the grid current Ig depending on the dark decay amount of the photosensitive member 1 mounted in the image forming apparatus 100 and a target value (set value) of the present charging voltage Vd. First, when the CPU 200 starts the potential control, the CPU 200 reads, from the storing portion 600, information on the dark decay amount of the photosensitive member 1 (S101) and information on the target value of the present charge potential Vd depending on a present environment or the like (S102). Then, the CPU 200 provides an instruction to a high-voltage output controller 800 after the CPU 200 starts turning-on of a light-discharging device 40, and then controls the charging voltage sources S1 to S4, and thus controls (adjusts) the charge potential Vd (S103). Then, the CPU 200 calculates the charging current Id in accordance with the above-described formulas (1) and (2) on the basis of the information on the dark decay amount ΔV of the photosensitive member 1 and the information on the target value (set value) of the present charge potential Vd (dev) (upstream charge potential Vd(V)dev in this embodiment) (S104). Further, the CPU 200 calculates the grid current Ig in accordance with the above-described formulas (3) and (4) on the basis of the information on the charging current Id calculated in S104 (S105). Then, the CPU 200 ends the procedure of the potential control.

<5-2. Procedure of Discriminating Lifetime of Grid Electrode>

Next, by using a flowchart of FIG. 15, a procedure of calculating the amount of use M of the grid electrode 31*b* during the printing operation and of discriminating the lifetime of the grid electrode 31*b* will be described.

When the CPU 200 starts the printing operation, the CPU reads the value of the present grid current Ig from the storing portion 600 (S201). Then, the CPU 200 causes the timer 400 to start measurement of a time simultaneously with a start of the charging operation (S202), and thereafter causes the image forming apparatus 100 to start the image forming operation (S203). Then, every printing of the image on one sheet, the CPU 200 successively calculates the amount of use M of the grid electrode 31*b*, the integrated value SUM (ΔM(t)) of the amount of use until now, and the lifetime ratio Life (%) in accordance with the above-described formulas (6) to (8) (S204 to S206). Then, the CPU 200 discriminates whether or not the lifetime ratio Life (%) reaches 100% (S207).

The CPU (output portion) 200 outputs information to the operating portion 300 in the case where the CPU 200 discriminated in S207 that the lifetime ratio Life (%) reached 100%, and then causes the operating portion 300 to display warning of the arrival of the grid electrode 31*b* at the end of its lifetime (i.e., to display for prompting the operator to exchange the grid electrode 31*b*) (S210). This is because the film thickness d of the surface coating C of the grid electrode 31*b* is 10 nm or less, and thus it is possible to discriminate that the grid electrode 31*b* reached the end of its lifetime. In this embodiment, at this time, display of providing warning of the arrival of the downstream grid electrode 32*b* at the end of its lifetime to the operator (i.e., display of prompting the operator to exchange the downstream grid electrode 32*b*) is also carried out in combination. Further, the warning display may also be made in any form, such as characters, turning-on of a lamp or voice when the information on the lifetime of the grid electrode can be notified to the operator. Next, the CPU 200 stops the measurement of the time by the timer 400 and causes the storing portion 600 to store the above-described measurement results and the above-described calculation results (S209), and then ends the printing operation.

On the other hand, in the case where the CPU 200 discriminated in S207 that the lifetime ratio Life (%) was less than 100%, the CPU 200 discriminates whether or not all of the image forming operations in the printing operation are ended (S208), and when the CPU 200 discriminated that all of the image forming operations were not ended, the CPU 200 continues the image forming operation. Further, in the case where the CPU 200 discriminated that all of the image forming operations were ended, the CPU 200 stops the measurement of the time by the timer 400 (S209), and causes the storing portion 600 to store the above-described measurement results and the above-described calculation results (S209), and then ends the printing operation.

In this embodiment, depending on the instruction from the operating portion 300 to the operator such as the user or the maintenance person, the CPU (output portion) 200 outputs, for example, the lifetime ratio Life (%) as maintenance information stored in the storing portion 600 and can cause the operating portion 300 to display the outputted lifetime ratio Life (%). As a result, the operator can confirm the information on the lifetimes of the grid electrodes 31*b* and 32*b* at any timing.

Further, in the procedure of FIG. 15, at the time when the CPU 200 discriminated that the lifetime ratio Life (%) reached 100%, the CPU 200 stopped the printing operation and display of prompting the operator to exchange the grid electrodes 31*b* and 32*b* was carried out. However, the present invention is not limited thereto, and display of providing warning that exchange timing of the grid electrodes 31*b* and 32*b* approaches may also be carried out. Further, on the basis of the lifetime ratio Life (%), a printable sheet number until the grid electrodes 31*b* and 32*b* reach the ends of the lifetimes thereof may also be predicted and displayed. The printable sheet number can be predicted by acquiring a print number of sheets required for changing the lifetime ratio Life (%) by a difference (remaining lifetime ratio) between the present lifetime ratio Life (%) and 100% on the basis of information on a print number of sheets until the present lifetime ratio Life (%). Further, using information on a daily average print number of sheets, the number of days required to carry out printing of the printable sheet number is determined, so that the number of days until the grid electrodes 31*b* and 32*b* reach the ends of the lifetimes thereof and the date of the arrival of the grid electrodes 31*b* and 32*b* at the ends of lifetimes thereof may also be predicted and displayed.

The image forming apparatus 100 may also have a function of sending information on the lifetimes of the grid electrodes 31*b* and 32*b* to an outside portion of the image forming apparatus 100. For example, as shown in FIG. 5, the image forming apparatus 100 may include a communicating portion 900 as a communicating means for sending the information to an external device communicatably connected with the image forming apparatus 100. The CPU 200 is capable of sending, to the external device of the image forming apparatus 100 at predetermined timing by using the communicating portion 900, for example, the lifetime ratio Life (%) as the maintenance information stored in the storing portion 600. As a result, it is possible to display the maintenance information at the external device so as to notify the operator such as the user or the maintenance person of the maintenance information. As the predetermined timing, for example, every execution of the potential control, the CPU 200 can send the maintenance information to the external device. Further, on demand from the external device, the CPU 200 may also send the maintenance information to the external device.

Further, in this embodiment, the operator inputted the information on the charging property of the photosensitive member 1 through the operating portion 300 and caused the storing portion 600 to store the information, but may also cause a storing portion (not shown), detachably mountable to the apparatus main assembly 110 together with the photosensitive member 1, to store the information on the charging property of the photosensitive member 1. In this case, the CPU 200 may read the information on the charging property of the photosensitive member 1 from the storing portion for each calculation of the grid current and may also read from the storing portion 600 when the grid current is calculated, after the information is once stored in the storing portion 600 in the apparatus main assembly 110. The storing portion detachably mountable to the apparatus main assembly 110 together with the photosensitive member 1 can be provided to a cartridge or the like detachably mountable to the apparatus main assembly 110 in the form of the photosensitive member 1 alone or in the form integral with other elements (such as a cleaning device).

Thus, in this embodiment, the image forming apparatus 100 includes the controller (output portion) 200 for acquiring and outputting the information on the lifetime of the grid electrode 31*b*. The controller 200 acquires the information on the lifetime of the grid electrode 31*b* on the basis of the index value M, of the amount of use of the grid electrode 31*b*, interrelated with a product of a value of the grid current flowing into the grid electrode 31*b* and a time for which the grid current flows into the grid electrode 31*b*. In this embodiment, the controller 200 acquires the value of the grid current on the basis of the information on the charging property (dark decay amount) of the photosensitive member 1, the information on the charge potential of the photosensitive member 1 and the current supplied to the discharging electrode 31*a*. Particularly, in this embodiment, the controller 200 acquires the index value $\Delta M(t)$ on the basis of the following product, i.e., a product of a predetermined reference value Ig(BASE) corresponding to the value of the grid electrode under the predetermined reference condition, the time $\Delta t$ for which the grid current flows into the grid electrode, the coefficient A depending on the value of the grid current, and the coefficient B depending on the aperture ratio of the grid electrode 31*b*. Incidentally, for example, in the case where the aperture ratio of the grid electrode used in the image forming apparatus 100 is fixed at a predetermined aperture ratio under the reference condition, acquirement of the amount of use M of the grid electrode depending on the aperture ratio of the grid electrode is not required. Then, the CPU 200 acquires the information on the lifetime of the grid electrode 31*b* on the basis of a relationship between the integrated value SUM ($\Delta M(t)$) of the above-described index value and the film thickness d of the surface layer C of the grid electrode 31*b* in the discharging electrode side. Incidentally, the information on the lifetime of the grid electrode 31*b* may be information on at least one of the arrival of the grid electrode 31*b* at the end of a set lifetime, approach of the grid electrode 31*b* to the end of the set lifetime, and the time when the grid electrode 31*b* reaches the end of the set lifetime.

As described above, according to this embodiment, even in the case where the amount of the discharging current flowing into the grid electrode changes depending on the setting condition of the charging property or the charge potential of the photosensitive member, the lifetime of the grid electrode can be discriminated with accuracy and at proper timing, it is possible to perform maintenance such as the exchange of the grid electrode. Further, according to this embodiment, even when the wire current of the charging device 3 or the aperture ratio of the grid electrode is changed, the lifetime of the grid electrode can be discriminated with accuracy and at proper timing, it is possible to perform the maintenance such as the exchange of the grid electrode. As a result, a degree of the decrease in film thickness of the surface coating is not less than a tolerable amount, so that generation of the image defect due to the charging non-uniformity of the photosensitive member resulting from the corrosion of the substrate of the grid electrode can be prevented. That is, according to this embodiment, in the constitution using the grid electrode having the surface layer containing the carbon atom as the main component, the change amount of the film thickness of the surface coating is predicted with accuracy, so that it becomes possible to accurately discriminate the lifetime of the grid electrode. As a result, at proper timing before the change amount of the surface coating film thickness is not less than the predetermined amount, the maintenance such as the exchange of the grid electrode can be performed, so that stability of the image quality can be improved.

Embodiment 2

Another embodiment of the present invention will be described. A basic structure and a basic operation of an image forming apparatus in this embodiment are the same as those in Embodiment 1. Accordingly, in the image forming apparatus in this embodiment, elements having the same or corresponding functions or structures as those of the image forming apparatus in Embodiment 1 are represented by the same reference numerals or symbols as in Embodiment 1 and will be omitted from detailed description.

In Embodiment 1, on the basis of the upstream grid electrode 31*b* provided in the upstream charger 31 which is a main charging-side charger of the upstream charger 31 and the downstream charger 32, discrimination of the lifetimes of both of the upstream grid electrode 31*b* and the downstream grid electrode 32*b* was carried out. However, in the case where the charging device 3 includes the plurality of grid electrodes 31*b* and 32*b* different in aperture ratio of the charging device 3, the times when the respective grid electrodes 31*b* and 32*b* reach the ends of their lifetimes are different from each other in some instances. Therefore, in this embodiment, the lifetimes of the upstream grid electrode 31*b* and the downstream grid electrode 32*b* are independently discriminated, so that the upstream grid electrode 31*b* and the downstream grid electrode 32*b* can be individually exchanged.

In this embodiment, calculation for discriminating the lifetimes of the upstream grid electrode 31*b* and the downstream grid electrode 32*b* is independently performed using the above-described formulas (1) to (4) and the above-described formulas (6) and (7) described in Embodiment 1.

In this embodiment, the formula (5), described in Embodiment 1, which is the basis of the relationship between the amount of use M and the film thickness d of the surface coating C and the pieces of the information shown in part (b) of FIG. 9 and part (b) of FIG. 10, which are the same as those in Embodiment 1 are used for both of the grid electrodes 31*b* and 32*b*. In this embodiment, similarly as in Embodiment 1, the downstream charger 32 is controlled so that a combined surface potential Vd(U+L) which is higher in absolute value than the upstream charge potential Vd(U) by 50 V is formed by biasing the upstream charge potential Vd(U) with the downstream charge potential Vd(L). Accordingly, in this embodiment, in the calculation for discriminating the lifetime of the downstream grid electrode 32*b*, the charging current Id necessary for the downstream charger 32 to increase the charge potential of the photosensitive member 1 by 50 V is calculated, so that the grid current Ig is calculated. That is, the calculation of the charging current Id for the downstream charger 32 corresponds to the calculation under a condition that Vd (charging position) in the formula (2) described in Embodiment 1 is 50 V.

Using a flowchart of FIG. 16, a procedure of acquiring values of the grid currents Ig, of the upstream charger 31 and the downstream charger 32, which are used for calculation of the amounts of use of the upstream grid electrode 31*b* and the downstream grid electrode 32*b*, respectively, will be described. As an example, the procedure during actuation of the image forming apparatus 100 will be described.

When the image forming apparatus 100 is actuated, the CPU 200 executes not only the potential control but also control of acquiring the values of the grid currents Ig of the respective chargers 31 and 32 depending on the dark decay amount of the photosensitive member 1 mounted in the image forming apparatus 100 and a target value (set value) of the charging voltage Vd. First, the CPU 200 reads, from the storing portion 600, the present lifetime ratios Life (%) of the upstream grid electrode 31*b* and the downstream grid electrode 32*b* (S301). Then, the CPU 200 discriminates whether or not each of the lifetime ratios Life (%) of the upstream grid electrode 31*b* and the downstream grid electrode 32*b* reaches 100% (S302). In the case where the CPU 200 discriminated in S302 that either one of the upstream grid electrode 31*b* and the downstream grid electrode 32*b* reached 100%, the CPU 200 causes the process to go to a procedure of SUB-A shown in FIG. 17 (S303). On the other hand, in the case where the CPU 200 discriminated in S302 that both of the lifetime ratios Life (%) of the grid electrodes 31*b* and 32*b* are less than 100%, the CPU 200 reads, from the storing portion 600, information on the dark decay amount of the photosensitive member 1 (S304) and information on the target value of the charge potential Vd (S305). Then, the CPU 200 provides an instruction to a high-voltage output controller 800 after the CPU 200 starts turning-on of a light-discharging device 40, and then controls the charging voltage sources S1 to S4, and thus controls (adjusts) the charge potential Vd (S306). Then, the CPU 200 independently calculates the charging currents Id and the grid currents Ig of the upstream charger 31 and the downstream charger 32 (S307, S308). Then, the CPU 200 ends the procedure of the potential control.

The procedure of SUB-A shown in FIG. 17 will be described. The CPU 200 causes the operating portion 300 to make display for causing the operator to check execution of the exchange the grid electrode, of the upstream grid electrode 31*b* and the downstream grid electrode 32*b*, discriminated that the lifetime ratio Life (%) thereof reached 100% in S301 of FIG. 16 (S401). Then, the CPU 200 resets SUM (ΔM(t)) of the grid electrode after the exchange to zero in the case where input showing that the associated grid electrode is exchanged is made by the operator through the operating portion 300, and then returns the process to S304 of the procedure of FIG. 16 (S402). On the other hand, in the case where the associated grid electrode is not exchanged, the CPU 200 causes the operating portion 300 to make display for prompting the operator to exchange the associated grid electrode (S403), and ends the procedure.

Incidentally, the procedure of the calculation of the integrated values SUM (ΔM(t)) of the amounts of use of the grid electrodes 31*b* and 32*b* and the lifetime discrimination during the printing operation in this embodiment is the same as the procedure of FIG. 15 described in Embodiment 1 except that the procedure is individually performed for each of the grid electrodes 31*b* and 32*b*. Accordingly, redundant description will be omitted.

As described above, according to this embodiment, the lifetimes of the upstream grid electrode 31*b* and the downstream grid electrode 32*b* can be individually discriminated. Further, according to this embodiment, even in the case where the upstream grid electrode 31*b* and the downstream grid electrode 32*b* are individually exchanged, the amounts of use M of the respective grid electrodes 31*b* and 32*b* can be individually controlled. As a result, the grid electrodes 31*b* and 32*b* can be exchanged at more proper timing depending on the amounts of use of the grid electrodes 31*b* and 32*b*, so that it is possible to efficiently use parts.

Embodiment 3

A further embodiment of the present invention will be described. A basic structure and a basic operation of an image forming apparatus in this embodiment are the same as those of the image forming apparatuses in Embodiments 1 and 2. Accordingly, in the image forming apparatus in this embodiment, elements having the same or corresponding functions or structures as those of the image forming apparatuses in Embodiments 1 and 2 are represented by the same reference numerals or symbols and will be omitted from detailed description.

In Embodiments 1 and 2, the value of the grid current was calculated on the basis of the information on the dark decay amount of the photosensitive member 1 and the information on the charge potential. On the other hand, in this embodiment, the value of the grid current is measured by an ammeter.

FIG. 18 is a schematic sectional view of a charging device 3 in this embodiment. FIG. 19 is a block diagram showing a control mode of a principal part of the image forming apparatus 100 in this embodiment.

In this embodiment, as current detecting means for detecting discharging currents (grid currents) flowing into the upstream grid electrode 31*b* and the downstream grid electrode 32*b*, first and second ammeters A1 and A2 are provided, respectively. The first ammeter A1 is connected between the upstream grid electrode 31*a* and the upstream grid voltage source S3, and the second ammeter A2 is connected between the downstream grid electrode 32*b* and the downstream grid voltage source S4. The first and second ammeters A1 and A2 are connected with the CPU 200 through a current detecting portion 850 which is a control circuit for controlling operations of the first and second ammeters A1 and A2 under control of the CPU 200. As a result, the CPU 200 can acquire a measurement result of the grid currents Ig(U) and Ig(L) flowing into the upstream grid electrode 31*b* and the downstream grid electrode 32*b*, respectively, in periods in which high charging voltages are applied to the upstream grid electrode 31*b* and the downstream grid electrodes 32*b*.

Using a flowchart of FIG. 20, a procedure of the calculation of the amount of use M of the grid electrode and the discrimination of the lifetime of the grid electrode will be described. In this embodiment, as regards the upstream grid electrode 31*b* and the downstream grid electrode 32*b*, the calculation of the amount of use M and the discrimination of the lifetime are independently carried out, but in the following description, distinction between "upstream" and "downstream" will be appropriately omitted. Further, in this embodiment, as regards the formula (5) and the pieces of the information shown in part (b) of FIG. 9 and part (b) of FIG. 10 which are a basis of the relationship between the amount of use M of the grid electrode and the film thickness d of the surface coating C, those which are the same as those in Embodiment 1 are used for both of the grid electrodes 31*b* and 32*b*.

When a printing operation is started the CPU 200 causes the timer 400 to start measurement of a time simultaneously with a start of the charging operation (S501), and thereafter causes the image forming apparatus 100 to start the image forming operation (S502). Then, the CPU 200 acquires the measurement result of the grid currents Ig(U) and Ig(L) by the first and second ammeters A1 and A2 (S503). Then, every printing of the image on one sheet, the CPU 200 successively calculates the amounts of use M of the grid electrodes 31*b* and 32*b*, the integrated value SUM (ΔM(t)) of the amount of use until now, and the lifetime ratio Life (%) in accordance with the above-described formulas (6) to (8) (S504 to S506). Then, the CPU 200 discriminates whether or not the lifetime ratio Life (%) of either one of the grid electrodes 31*b* and 32*b* reaches 100% (S507).

In the case where the CPU 200 discriminated in S507 that the lifetime ratio Life (%) of either one of the grid electrodes 31*b* and 32*b* reached 100%, the CPU 200 then causes the operating portion 300 to display warning of the arrival of the associated grid electrode at the end of its lifetime (i.e., to display for prompting the operator to exchange the associated grid electrode) (S510).

Next, the CPU 200 stops the measurement of the time by the timer 400 and causes the storing portion 600 to store the above-described measurement results and the above-described calculation results (S509), and then ends the printing operation.

On the other hand, in the case where the CPU 200 discriminated in S507 that the lifetime ratios Life (%) of both of the grid electrodes 31*b* and 32*b* were less than 100%, the CPU 200 discriminates whether or not all of the image forming operations in the printing operation are ended (S508), and when the CPU 200 discriminated that all of the image forming operations were not ended, the CPU 200 continues the image forming operation. Further, in the case where the CPU 200 discriminated that all of the image forming operations were ended, the CPU 200 stops the measurement of the time by the timer 400 (S509), and causes the storing portion 600 to store the above-described measurement results and the above-described calculation results (S509), and then ends the printing operation.

As described above, according to this embodiment, by measuring the grid currents with the first and second ammeters A1 and A2, there is no need to effect control such that the grid currents are calculated using the information on the dark decay amount of the photosensitive member 1 and the information on the charge potential of the photosensitive member 1. As a result, the control can be simplified. According to this embodiment, on the basis of actually measured values of the grid currents, the lifetimes of the grid electrodes 31*b* and 32*b* can be discriminated. As a result, improvement in detection accuracy of the lifetimes of the grid electrodes 31*b* and 32*b* can be realized.

Other Embodiments

In the above, the present invention was described based on specific embodiments, but is not limited to the above-described embodiments.

In the above-described embodiments, the image forming apparatus includes the two corona chargers, but the present invention is not limited thereto. The image forming apparatus may also include only a single corona charger or three or more corona chargers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-225552 filed on Nov. 18, 2016, which is hereby incorporated by reference herein in its entirety.

What is claimed is:

1. An image forming apparatus comprising:

a photosensitive member;

a corona charger including a discharging electrode and a grid electrode having a surface layer containing carbon atoms as a main component and configured to electrically charge said photosensitive member under application of a voltage to said discharging electrode and said grid electrode; and an output portion configured to output information on a lifetime of said grid electrode, wherein said output portion outputs the information on the basis of an index value of an amount of use of said grid electrode correlating with a product of a value of a grid current flowing through said grid electrode and a time of flowing of the grid current through said grid electrode.

2. An image forming apparatus according to claim 1, wherein said output portion outputs the information on the lifetime on the basis of information on a charging property of said photosensitive member, information on a charge potential of said photosensitive member and information on a current supplied to said discharging electrode.

3. An image forming apparatus according to claim 1, further comprising a current detecting member configured to detect the grid current, wherein said output portion acquires the value of the grid current by said current detecting member.

4. An image forming apparatus according to claim 1, wherein said output portion acquires the index value on the basis of a product of a predetermined reference value corresponding to the value of the current flowing through said grid electrode under a predetermined reference condition, the time of flowing of the grid current through said grid electrode, and a coefficient depending on the value of the grid current.

5. An image forming apparatus according to claim 1, wherein said output portion acquires the index value on the basis of a product of a predetermined reference value corresponding to the value of the current flowing through said grid electrode under a predetermined reference condition, the time of flowing of the grid current through said grid electrode, a coefficient depending on the value of the grid current, and a charging depending on an aperture ratio of said grid electrode.

6. An image forming apparatus according to claim 1, wherein said output portion outputs the information on the lifetime of said grid electrode on the basis of a relationship between an integrated value of the index value and a film thickness of said surface layer of said grid electrode at a discharging electrode side.

7. An image forming apparatus according to claim 1, further comprising a plurality of corona chargers, wherein said output portion outputs the information of the lifetime of said grid electrode of the corona charger, of said plurality of corona chargers, having a largest aperture ratio of said grid electrode.

8. An image forming apparatus according to claim 1, further comprising a plurality of corona chargers, wherein said output portion outputs the information of the lifetime of said grid electrode of the corona charger, of said plurality of corona chargers, providing a greatest absolute value of a charge potential formed on said photosensitive member.

9. An image forming apparatus according to claim 1, further comprising a plurality of corona chargers, wherein said output portion outputs the information of the lifetime of each of said plurality of corona chargers.

10. An image forming apparatus according to claim 1, further comprising a display portion configured to display the information, wherein said output portion causes said display portion to display the information on the lifetime of said grid electrode.

11. An image forming apparatus according to claim 1, further comprising a sending portion configured to send the information to an external device communicably connected with said image forming apparatus, wherein said output portion outputs, to said sending portion, the information on the lifetime of said grid electrode so that said sending portion sends the information to the external device.

12. An image forming apparatus according to claim 1, wherein said output portion outputs, as the information on the lifetime of said grid electrode, information on at least one of arrival of the lifetime of said grid electrode at a set lifetime, approach of the lifetime of said grid electrode to the set lifetime, and a period in which the lifetime of said grid electrode reaches the set lifetime.

13. An image forming apparatus according to claim 1, wherein a charge polarity of said photosensitive member is a negative polarity.

14. An image forming apparatus comprising:

a photosensitive member;

a corona charger including a discharging electrode and a grid electrode having a surface layer containing carbon atoms as a main component and configured to electrically charge said photosensitive member under application of a voltage to said discharging electrode and said grid electrode;

an output portion configured to output information on a lifetime of said grid electrode, wherein said output portion outputs the information on the basis of a grid current flowing through said grid electrode and a time of flowing of the grid current through said grid electrode; and a current detecting member configured to detect the grid current, wherein said output portion acquires the value of the grid current by said current detecting member.

15. An image forming apparatus according to claim 14, further comprising a plurality of corona chargers, wherein said output portion outputs the information of the lifetime of each of said plurality of corona chargers.

16. An image forming apparatus according to claim 14, further comprising a display portion configured to display the information, wherein said output portion causes said display portion to display the information on the lifetime of said grid electrode.

17. An image forming apparatus comprising:

a photosensitive member;

a corona charger including a discharging electrode and a grid electrode having a surface layer containing carbon atoms as a main component and configured to electrically charge said photosensitive member under application of a voltage to said discharging electrode and said grid electrode:

an output portion configured to output information on a lifetime of said grid electrode, wherein said output portion outputs the information on the basis of a grid current flowing through said grid electrode and a time of flowing of the grid current through said grid electrode; and a sending portion configured to send the information to an external device communicatably connected with said image forming apparatus, wherein said output portion outputs, to said sending portion, the information on the lifetime of said grid electrode so that said sending portion sends the information to the external device.

18. An image forming apparatus comprising:

a photosensitive member;

a corona charger including a discharging electrode and a grid electrode having a surface layer containing carbon atoms as a main component and configured to electrically charge said photosensitive member under application of a voltage to said discharging electrode and said grid electrode; and an output portion configured to output information on a lifetime of said grid electrode, wherein said output portion outputs the information on the basis of a grid current flowing through said grid electrode and a time of flowing of the grid current through said grid electrode, and wherein said output portion outputs, as the information on the lifetime of said grid electrode, information on at least one of arrival of the lifetime of said grid electrode at a set lifetime, approach of the lifetime of said grid electrode to the set lifetime, and a period in which the lifetime of said grid electrode reaches the set lifetime.

* * * * *